US011680413B2

(12) United States Patent
Ylikangas et al.

(10) Patent No.: US 11,680,413 B2
(45) Date of Patent: Jun. 20, 2023

(54) BUILDING PANEL

(71) Applicant: Välinge Innovation AB, Viken (SE)

(72) Inventors: Roger Ylikangas, Lerberget (SE); Anders Nilsson, Helsingborg (SE); Karl Quist, Höganäs (SE)

(73) Assignee: VALINGE INNOVATION AB, Viken (SE)

( * ) Notice: Subject to any disclaimer, the term of this patent is extended or adjusted under 35 U.S.C. 154(b) by 700 days.

(21) Appl. No.: 16/738,737

(22) Filed: Jan. 9, 2020

(65) Prior Publication Data

US 2021/0087829 A1 Mar. 25, 2021

(30) Foreign Application Priority Data

Sep. 24, 2019 (EP) ..... 19199234

(51) Int. Cl.
*B27G 13/14* (2006.01)
*B27M 3/00* (2006.01)
(Continued)

(52) U.S. Cl.
CPC ..... *E04F 15/02038* (2013.01); *B27G 13/14* (2013.01); *B27M 3/0066* (2013.01);
(Continued)

(58) Field of Classification Search
CPC ..... B27M 1/08; B27M 3/002; B27M 3/0026; B27M 3/006; B27M 3/0066; B27M 3/04;
(Continued)

(56) References Cited

U.S. PATENT DOCUMENTS 2,110,728 A 3/1938 Hoggatt
2,430,200 A 11/1947 Wilson
(Continued)

FOREIGN PATENT DOCUMENTS

CN 101 391 427 A1 3/2009
DE 138 992 C 7/1901
(Continued)

OTHER PUBLICATIONS

U.S. Appl. No. 16/738,602 entitled "Building Panel," filed in the U.S. Patent and Trademark Office Jan. 9, 2020.
(Continued)

*Primary Examiner* — Shelley M Self
*Assistant Examiner* — Jared O Brown
(74) *Attorney, Agent, or Firm* — Buchanan Ingersoll & Rooney P.C.

(57) ABSTRACT

Building panels, such as floor panels or wall panels. The panels including a first mechanical locking system at respective parallel and opposite third and fourth edges, such as long edges, configured to cooperate for horizontal and vertical locking between two adjacent building panels, preferably by means of a folding motion. The panels further including a second locking system at respective parallel and opposite first and second edges, such as short edges, configured to cooperate for horizontal and vertical locking of two adjacent building panels. An upper edge portion of one of the third edge or fourth edge, preferably the third edge, includes a first lower lip portion configured to cooperate with a first upper lip portion of an upper edge portion of the other of the third and fourth edge of an adjacent panel when the third and fourth edges are arranged in locking engagement.

13 Claims, 10 Drawing Sheets

(51) Int. Cl.
*B27M 3/06* (2006.01)
*E04F 15/02* (2006.01)

(52) U.S. Cl.
CPC ..... *B27M 3/06* (2013.01); *E04F 2201/0146* (2013.01); *E04F 2201/0153* (2013.01); *E04F 2201/0161* (2013.01); *E04F 2201/023* (2013.01); *E04F 2201/043* (2013.01); *E04F 2201/044* (2013.01)

(58) Field of Classification Search
CPC ... B27M 3/06; B27F 12/04; B27F 1/06; B27F 1/16; B27F 5/00; B27F 5/02; B27D 1/10; B27D 5/006
See application file for complete search history.

(56) References Cited

U.S. PATENT DOCUMENTS

| | | | |
|---|---|---|---|
| 3,187,612 | A | 6/1965 | Hervey |
| 3,656,220 | A | 4/1972 | Dupuis |
| 3,731,445 | A | 5/1973 | Hoffmann et al. |
| 4,083,390 | A | 4/1978 | Ingham |
| 4,169,688 | A | 10/1979 | Toshio |
| 4,426,820 | A | 1/1984 | Terbrack et al. |
| 4,495,733 | A | 1/1985 | Börner et al. |
| 4,498,361 | A | 2/1985 | Grace |
| 4,512,131 | A | 4/1985 | Laramore |
| 4,564,320 | A | 1/1986 | Roseliep |
| 4,599,841 | A | 7/1986 | Haid |
| 4,819,932 | A | 4/1989 | Trotter, Jr. |
| 5,135,597 | A | 8/1992 | Barker |
| 5,295,341 | A | 3/1994 | Kajiwara |
| 5,352,068 | A | 10/1994 | Roseliep |
| 5,577,357 | A | 11/1996 | Civelli |
| 5,860,267 | A | 1/1999 | Pervan |
| 5,950,389 | A | 9/1999 | Porter |
| 6,006,486 | A | 12/1999 | Moriau et al. |
| 6,182,410 | B1 | 2/2001 | Pervan |
| 6,203,653 | B1 | 3/2001 | Seidner |
| 6,254,301 | B1 | 7/2001 | Hatch |
| 6,295,779 | B1 | 10/2001 | Canfield |
| 6,332,733 | B1 | 12/2001 | Hamberger et al. |
| 6,339,908 | B1 | 1/2002 | Chuang |
| 6,358,352 | B1 | 3/2002 | Schmidt |
| 6,418,683 | B1 | 7/2002 | Martensson et al. |
| 6,450,235 | B1 | 9/2002 | Lee |
| 6,490,836 | B1 | 12/2002 | Moriau et al. |
| 6,497,079 | B1 | 12/2002 | Pletzer et al. |
| 6,576,079 | B1 | 6/2003 | Kai |
| 6,584,747 | B2 | 7/2003 | Kettler et al. |
| 6,591,568 | B1 | 7/2003 | Pålsson |
| 6,681,820 | B2 | 1/2004 | Olofsson |
| 6,729,091 | B1 | 5/2004 | Martensson |
| 6,763,643 | B1 | 7/2004 | Martensson |
| 6,802,166 | B1 | 10/2004 | Durnberger |
| 6,854,235 | B2 | 2/2005 | Martensson |
| 6,880,307 | B2 | 4/2005 | Schwitte et al. |
| 7,040,068 | B2 | 5/2006 | Moriau et al. |
| 7,051,486 | B2 | 5/2006 | Pervan |
| 7,127,860 | B2 | 10/2006 | Pervan et al. |
| 7,171,791 | B2 | 2/2007 | Pervan |
| 7,637,068 | B2 | 12/2009 | Pervan |
| 7,677,005 | B2 | 3/2010 | Pervan |
| 7,757,452 | B2 | 7/2010 | Pervan |
| 7,762,293 | B2 | 7/2010 | Pervan |
| 7,841,150 | B2 | 11/2010 | Pervan |
| 8,495,849 | B2 | 7/2013 | Pervan |
| 8,511,031 | B2 | 8/2013 | Bergelin et al. |
| 8,631,622 | B2 | 1/2014 | Baert et al. |
| 8,733,410 | B2 | 5/2014 | Pervan |
| 8,931,174 | B2 | 1/2015 | Pervan et al. |
| 9,314,888 | B2 | 4/2016 | Pervan et al. |
| 9,816,270 | B2 | 11/2017 | Pervan et al. |
| 10,279,404 | B2 | 5/2019 | Pervan et al. |
| 10,500,684 | B2 | 12/2019 | Pervan et al. |
| 10,697,175 | B2 | 6/2020 | Pervan et al. |
| 2002/0025232 | A1 | 2/2002 | Miller |
| 2002/0057942 | A1 | 5/2002 | Hamberger et al. |
| 2003/0037504 | A1 | 2/2003 | Schwitte et al. |
| 2003/0140478 | A1 | 7/2003 | Olofsson |
| 2003/0154681 | A1 | 8/2003 | Pletzer et al. |
| 2003/0180091 | A1 | 9/2003 | Stridsman |
| 2004/0016196 | A1 | 1/2004 | Pervan |
| 2004/0035078 | A1 | 2/2004 | Pervan |
| 2004/0206036 | A1 | 10/2004 | Pervan |
| 2004/0211143 | A1 | 10/2004 | Hannig |
| 2005/0016107 | A1 | 1/2005 | Rosenthal et al. |
| 2005/0034405 | A1 | 2/2005 | Pervan |
| 2005/0160694 | A1 | 7/2005 | Pervan |
| 2005/0166514 | A1 | 8/2005 | Pervan |
| 2005/0252130 | A1 | 11/2005 | Martensson |
| 2006/0070333 | A1 | 4/2006 | Pervan |
| 2007/0028547 | A1 | 2/2007 | Grafenauer et al. |
| 2007/0175148 | A1 | 8/2007 | Bergelin et al. |
| 2008/0041008 | A1 | 2/2008 | Pervan |
| 2008/0134607 | A1 | 6/2008 | Pervan |
| 2008/0168737 | A1 | 7/2008 | Pervan |
| 2008/0172856 | A1 | 7/2008 | Brouckaert et al. |
| 2008/0216434 | A1 | 9/2008 | Pervan |
| 2008/0216920 | A1 | 9/2008 | Pervan |
| 2009/0038254 | A1 | 2/2009 | Steele et al. |
| 2009/0049792 | A1 | 2/2009 | Capelle et al. |
| 2009/0101236 | A1 | 4/2009 | Boucke |
| 2009/0133353 | A1 | 5/2009 | Pervan et al. |
| 2009/0193748 | A1* | 8/2009 | Boo ..... B27F 1/02 408/1 R |
| 2009/0223600 | A1 | 9/2009 | Tappan |
| 2009/0260313 | A1 | 10/2009 | Segaert |
| 2010/0170189 | A1 | 7/2010 | Schulte |
| 2011/0023302 | A1 | 2/2011 | Pervan et al. |
| 2011/0023303 | A1 | 2/2011 | Pervan et al. |
| 2011/0030303 | A1 | 2/2011 | Pervan et al. |
| 2011/0209430 | A1 | 9/2011 | Pervan |
| 2012/0174521 | A1 | 7/2012 | Schulte |
| 2013/0192158 | A1 | 8/2013 | Cappelle et al. |
| 2013/0333182 | A1 | 12/2013 | Pervan et al. |
| 2014/0223852 | A1 | 8/2014 | Pervan |
| 2015/0107079 | A1 | 4/2015 | Pervan et al. |
| 2016/0221212 | A1 | 8/2016 | Pervan et al. |
| 2017/0254076 | A1 | 9/2017 | Pervan et al. |
| 2018/0119429 | A1 | 5/2018 | Schulte |
| 2019/0262915 | A1* | 8/2019 | Pervan ..... B27M 3/04 |
| 2019/0271165 | A1 | 9/2019 | Boo |
| 2020/0284034 | A1 | 9/2020 | Pervan et al. |

FOREIGN PATENT DOCUMENTS

| | | | |
|---|---|---|---|
| DE | 142 293 | C | 7/1902 |
| DE | 2 159 042 | | 6/1973 |
| DE | 23 37 254 | A1 | 2/1975 |
| DE | 33 43 601 | A1 | 6/1985 |
| DE | 33 43 601 | C2 | 6/1985 |
| DE | 42 15 273 | A1 | 11/1993 |
| DE | 42 42 530 | A1 | 6/1994 |
| DE | 196 01 322 | A | 5/1997 |
| DE | 200 02 744 | U1 | 8/2000 |
| DE | 100 48 679 | A1 | 12/2001 |
| DE | 102 41 769 | B3 | 4/2004 |
| DE | 10 2010 024 513 | A1 | 12/2011 |
| DE | 20 2015 101 572 | U1 | 4/2015 |
| DE | 10 2014 103 176 | A1 | 9/2015 |
| EP | 1 048 423 | A2 | 11/2000 |
| EP | 1 120 515 | A1 | 8/2001 |
| EP | 1 146 182 | A2 | 10/2001 |
| EP | 1 754 582 | A1 | 2/2007 |
| EP | 1 349 995 | B1 | 1/2008 |
| FR | 2 810 060 | A1 | 12/2001 |
| JP | H06-146553 | A | 5/1994 |
| PL | 197 416 | B1 | 3/2008 |
| WO | WO 94/26999 | A1 | 11/1994 |
| WO | WO 96/27721 | A1 | 9/1996 |
| WO | WO 97/47834 | A1 | 12/1997 |
| WO | WO 99/66151 | A1 | 12/1999 |
| WO | WO 99/66152 | A1 | 12/1999 |

(56) References Cited

FOREIGN PATENT DOCUMENTS

| | | | |
|---|---|---|---|
| WO | WO 00/20705 | A1 | 4/2000 |
| WO | WO 00/20706 | A1 | 4/2000 |
| WO | WO 00/47841 | A1 | 8/2000 |
| WO | WO 01/53628 | A1 | 7/2001 |
| WO | WO 01/75247 | A1 | 10/2001 |
| WO | WO 02/055809 | A1 | 7/2002 |
| WO | WO 02/055810 | A1 | 7/2002 |
| WO | WO 03/012224 | A1 | 2/2003 |
| WO | WO 03/083234 | A1 | 10/2003 |
| WO | WO 2004/079130 | A1 | 9/2004 |
| WO | WO 2005/068747 | A1 | 7/2005 |
| WO | WO 2006/043893 | A1 | 4/2006 |
| WO | WO 2007/015669 | A2 | 2/2007 |
| WO | WO 2007/015669 | A3 | 2/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/064692 | A1 | 6/2008 |
| WO | WO 2009/016446 | A2 | 2/2009 |
| WO | WO 2009/020949 | A1 | 2/2009 |
| WO | WO 2009/116926 | A1 | 9/2009 |
| WO | WO 2010/015138 | A1 | 2/2010 |
| WO | WO 2014/108129 | A1 | 7/2014 |

OTHER PUBLICATIONS

U.S. Appl. No. 16/738,725 entitled "Building Panel," filed in the U.S. Patent and Trademark Office Jan. 9, 2020.

International Search Report and Written Opinion issued in PCT/EP2020/050446, dated Jul. 3, 2020, European Patent Office, Rijswijk, NL, 14 pages.

International Search Report and Written Opinion issued in PCT/EP2020/050442, dated Jun. 8, 2020, European Patent Office, Rijswijk, NL, 12 pages.

International Search Report and Written Opinion issued in PCT/EP2020/050443, dated Jun. 26, 2020, European Patent Office, Rijswijk, NL, 23 pages.

Extended European Search Report issued in EP 19199234.6, dated Apr. 1, 2020, European Patent Office, Munich, DE, 8 pages.

"What is Broaching Used for?", Received May 12, 2010, http://www.wisegeek.com/what-is-broaching-used-for.htm, 1 page.

Grönlund, Anders, Träbearbetninq, 1986, ISBN 91-970513-2-2, pp. 16-23, published by Institutet for Trateknisk Forskning, Stockholm, Sweden, with Summary Translation.

Laminate Flooring Tips (http://flooring.lifetips.com/cat/61734/laminate-flooring-tips/index.html). Copyright 2000. 12 pages.

Pervan, Darko: VA073a Zip Loc, Ip.com Journal, Ip.com Inc., West Henrietta, NY, US, Sep. 13, 2011, XP013144910, ISSN: 1533-0001, 36 pages.

* cited by examiner

A-A

B-B

C-C

D-D

BUILDING PANEL

CROSS REFERENCE TO RELATED APPLICATIONS

The present application claims the benefit of European Application No. 19199234.6, filed on Sep. 24, 2019. The entire contents of European Application No. 19199234.6 are hereby incorporated herein by reference in their entirety.

TECHNICAL FIELD

The disclosure generally relates to the field of building panels.

BACKGROUND OF INVENTION

Laminate flooring usually comprise a core of a 6-12 mm fibre board, a 0.2-0.8 mm thick upper decorative surface layer of laminate and a 0.1-0.6 mm thick lower balancing layer of laminate, plastic, paper or like material. A laminate surface comprises melamine-impregnated paper. The most common core material is fibreboard with high density and good stability usually called HDF—High Density Fibreboard. Sometimes also MDF—Medium Density Fibreboard—is used as core.

Laminate floor panels of this type have been joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminium or HDF, which are integrated with the floor panel, i.e. joined with the floor panel in connection with the manufacture thereof.

The main advantages of floating floors with mechanical locking systems are that they are easy to install. They may also easily be taken up again and used once more at a different location. However, know systems suffer from drawbacks, for example in respect moisture control. As such, there is room for improvements in the technical field.

SUMMARY

An overall objective of the present disclosure is to provide a building panel which facilitates improved control of moisture, such as water. Improved moisture control may include not limited to improved sealing between assembled building panels, improved resistance to water penetration through a surface comprising assembled building panels.

It is a further object to provide a building panel which facilitates alignment of assembled such building panels.

It is thus a further object of the present invention to provide a building panel which facilitates improved moisture control of a lay of building panels, such as a floating floor. In particular, it is an object to provide a building panel for improving moisture control and/or at least reduce the possibility of water penetration of the T-joints of such floor lay.

The above objects of embodiments of the invention may be achieved wholly or partly by locking systems and floor panels according to the disclosure. Embodiments of the invention are evident from the description and drawings.

Definition of Some Terms

In the following text, the visible surface of the installed floor panel is called "front surface", while the opposite side of the floor panel facing the subfloor is called "rear surface". "Horizontal plane" relates to a plane, which is parallel to the front surface. Directly adjoining upper parts of two neighboring joint edges of two joined floor panels together define a "vertical plane" perpendicular to the horizontal plane. The outer parts of the floor panel at the edge of the floor panel between the front surface and the rear surface are called "joint edge". As a rule, the joint edge has several "joint surfaces" which can be vertical, horizontal, angled, rounded, beveled, etc. These joint surfaces exist on different materials, for instance laminate, fiberboard, wood, plastic, metal (in particular aluminum) or sealing materials.

By "Vertical locking" means locking parallel to the vertical plane. "Horizontal locking" means locking parallel to the horizontal plane.

"Up" means towards the front surface, "down" means towards the rear surface, "inwardly" means mainly horizontally towards an inner and centre part of the panel and "outwardly" means mainly horizontally away from the centre part of the panel.

"Locking" or "locking system" means cooperating connecting means which interconnect the floor panels vertically and/or horizontally. "Mechanical locking system" means that locking can take place without glue. Mechanical locking systems can in many cases also be joined by glue.

"Decorative surface layer" means a surface layer, which is mainly intended to give the floor its decorative appearance. "Wear resistant surface layer" relates to a high abrasive surface layer, which is mainly adapted to improve the durability of the front surface. A "decorative wear resistant surface layer" is a layer, which is intended to give the floor its decorative appearance as well as improve the durability of the front surface. A surface layer is typically applied to the core.

Embodiments of the present invention are particularly suitable for use in floating floors, which are formed of floor panels which are joined mechanically with a locking system integrated with the floor panel, i.e. mounted at the factory, are made up of one or more upper layers of wood or wood veneer, decorative laminate, powder based surfaces or decorative plastic material, an intermediate core of wood-fibre-based material or plastic material and preferably a lower balancing layer on the rear side of the core. Floor panels of solid wood or with a surface layer of cork, linoleum, rubber or soft wear layers, for instance needle felt glued to a board, printed and preferably also varnished surface and floors with hard surfaces such as stone, tile and similar materials are included.

The following description of known technique, problems of known systems and objects and features of embodiments of the invention will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of embodiments of the invention. The panels may be square. It should be emphasised that embodiments of the invention may be used in any floor panel and it may be combined with all types of known locking system formed on the long edges and/or short edges, where the floor panels are intended to be joined using a mechanical locking system connecting the panels in the horizontal and/or vertical directions on at least two adjacent edges.

In one aspect of the invention there is provided a method for producing mechanical locking systems in a building panel, such as a floor panels or wall panels, the panel comprising a first mechanical locking system at opposite third and fourth edges, such as long edges, the mechanical locking system comprising a first pair of horizontal locking surfaces in the third edge and a second pair of horizontal locking surfaces in the fourth edge for horizontal locking of adjacent panels, the first pair of horizontal locking surfaces comprising a first upper edge surface of the panel and a locking element surface provided on a locking element protruding from a locking strip, the second pair of horizontal locking surfaces comprising a second upper edge surface and a locking groove surface provided by a locking groove configured to receive a locking element of an adjacent panel in response to a folding movement of the adjacent panel for horizontal locking of the panels from parting away from each other, a second locking system at respective parallel and opposite first and second edges, such as short edges, configured to cooperate for horizontal and vertical locking of two adjacent building panels, preferably by means of a vertical motion, such as vertical folding, a first pair of vertical locking surfaces in the third edge and a second pair of vertical locking surfaces in the fourth edge for vertical locking of adjacent panels, the first pair of vertical locking surfaces comprising a first lower lip portion disposed below said first upper edge surface and a tongue groove surface provided by a tongue groove configured to receive a locking tongue of a fourth edge of an adjacent panel for vertical locking of the adjacent panel in a direction along the normal of a front surface of the panel, the second pair of vertical locking surfaces comprising an upper surface of the locking tongue and a first upper lip portion disposed between a front surface of the panel and the locking tongue and below a second upper edge surface;

the first lower lip portion being configured to cooperate with the first upper lip portion provided below the second upper edge surface of an adjacent panel for vertical locking of the panels when said third and fourth edges are assembled in the locking position, the method comprising:

- displacing the floor panel in a feeding direction with its third edge relative a first tool set and relative a second tool set;
- the first tool set comprising a first and second tool member arranged on a common rotary shaft; the second tool set comprises a first and second tool member arranged on a common rotary shaft;
- forming by the first tool set, preferably the first tool member, at least part of the locking element and at least part of the locking strip; wherein forming at least part of the locking element comprises forming at least part of the locking element surface;
- forming with the first tool set, preferably the second tool member, at least part of locking strip, the first upper edge surface and the first lower lip portion;
- forming with the second tool set, preferably the first tool member, at least a part of the locking element;
- forming with the second tool set, preferably the second tool member, at least part of the tongue groove, wherein forming at least part of the tongue groove comprises forming at least part of the tongue groove surface.

Further advantages and embodiments being set forth in the appended dependent claims and detailed description.

BRIEF DESCRIPTION OF DRAWINGS

The disclosure will in the following be described in connection to exemplary embodiments and in greater detail with reference to the appended schematic drawings, wherein.

DETAILED DESCRIPTION

Embodiments of the disclosure will now be described with reference to the appended schematic drawings. It should be emphasised that improved or different functions may be achieved using combinations of the embodiments.

All embodiments may be used separately or in combinations. Angles, dimensions, rounded parts, spaces between surfaces, etc. are only examples and may be adjusted within the basic principles of the invention.

Figure 1:
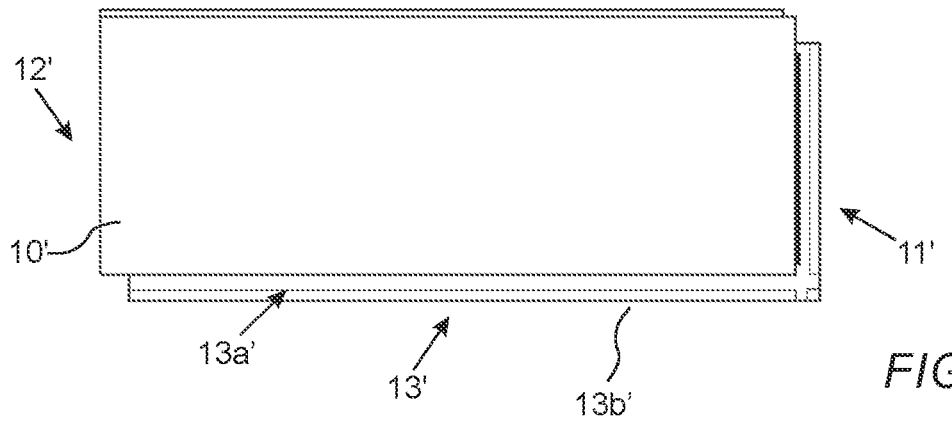
FIG. 1 PRIOR ART
FIG. 1 shows a schematic illustration of a floor board comprising locking systems according to known technology.
Figure 2:
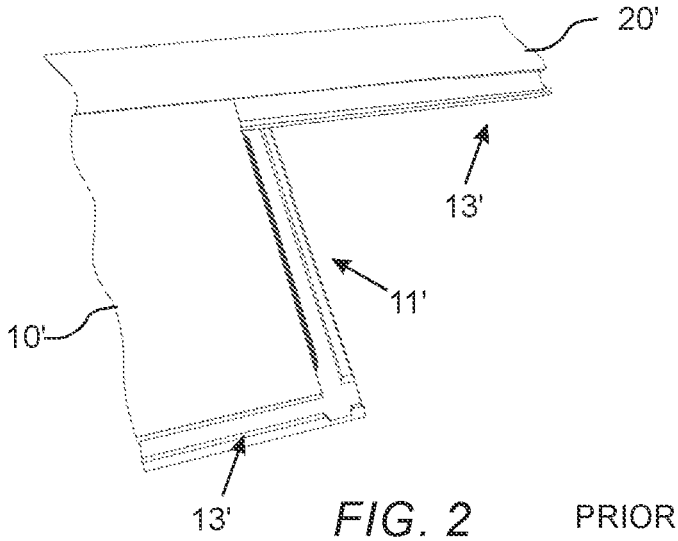
FIG. 2 PRIOR ART
FIG. 2 shows a schematic illustration of the floor board of FIG. 1 in locked position with an adjacent building panel.

A known building panel comprising mechanical locking systems is illustrated in FIG. 1.

A mechanical locking system typically comprises a tongue and a tongue groove for vertical locking and a locking element and a locking groove for horizontal locking. It typically has at least four pairs of active cooperating locking surfaces, two pairs for vertical locking and two pairs for horizontal locking. The locking system comprises several other surfaces, which generally are not in contact with each other and can therefore be produced with considerably larger tolerance then the cooperating locking surfaces.

Laminate floorings are usually composed of a core consisting of a 6-9 mm fiberboard, a 0.20 mm thick upper surface layer and a lower balancing layer. The surface layer provides appearance and durability to the floor panels. The core provides stability and the balancing layer keeps the board level when the relative humidity (RH) varies during the year.

Figure 3:
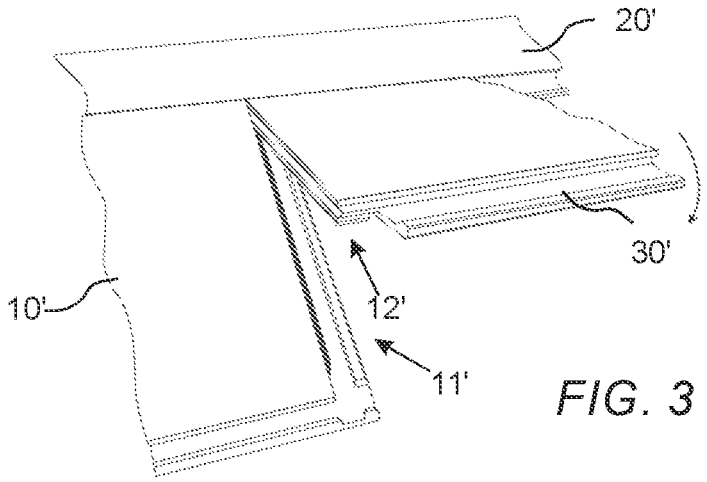
FIG. 3 PRIOR ART
FIG. 3 shows a schematic illustration of a further floor board being assembled to the floorboards of FIG. 2 by means of a vertical motion (vertical folding).
Figure 4A:
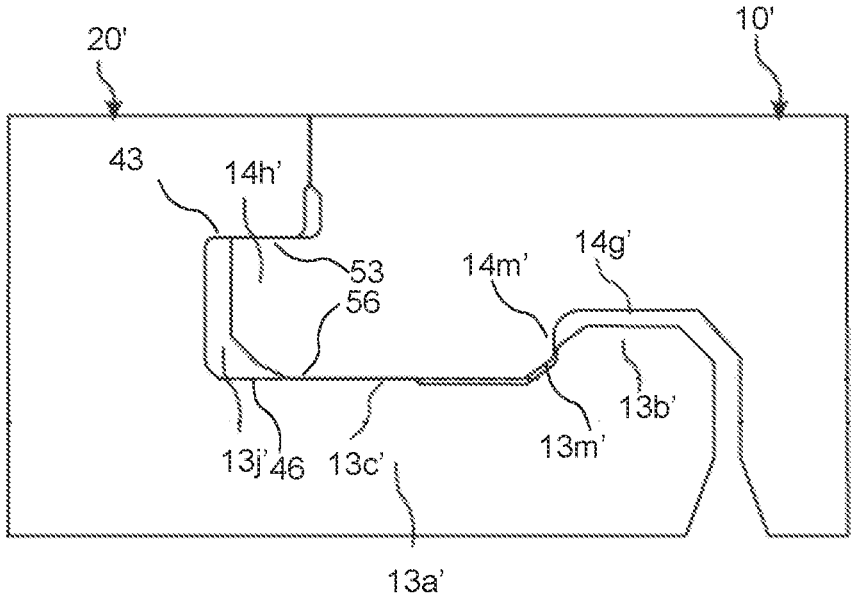
FIG 4A PRIOR ART
FIGS. 4A-4B show schematic illustrations of a cross sectional views of locking systems according to known technology.

FIG. 4A illustrates, according to known art, a typical first mechanical locking system (strip lock), which can be locked with angling (see FIG. 3) and which is widely used on the market, in particular for assembling respective long edges of panels to each other. FIG. 4A shows a vertical cross section of the floor panel of a part of a long side 13' of the floor panel 20', as well as a part of a long side 14' of the floor panel 10'. The bodies of the floor panels 10', 20' can be composed of a fiberboard body or core, which supports here, a wear resistant and decorative surface layer on its front surface and a balancing layer on its rear side (underside). The locking system has a tongue 14*h'* and a tongue groove 13*j'* which locks the panels in a vertical direction V with upper 53 and lower 56 tongue surfaces that cooperate with upper 43 and lower 46 tongue grooves surfaces. A locking strip 13*a'* is formed from the body and supports a locking element 13*b'*. Therefore the locking strip 13*a'* and the locking element 13*b'* in a way constitute an extension of the lower part of the tongue groove 13*j'*. The locking element 13*b'* formed on the strip 13*a'* has an operative locking element surface 13*m'* which cooperates with an operative locking groove surface 14*m'* in a locking groove 14*g'* in the opposite locking groove side of the floor panel 10'. By the engagement between the horizontal operative locking surfaces 13*m'*, 14*m'* a horizontal locking of the floor panels 10', 20' transversely of the joint edge is obtained if the panels are attempted to be pulled apart.

Figure 4B:
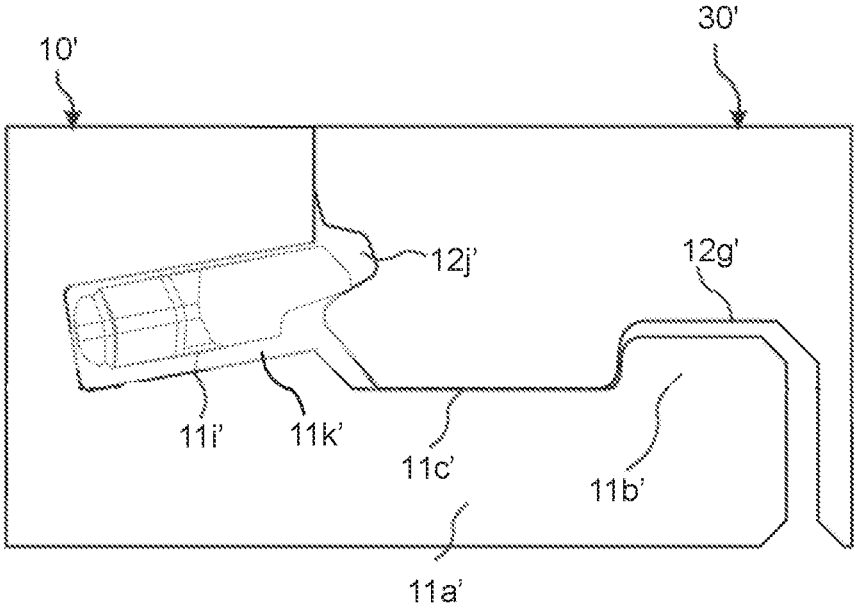
FIG. 4B PRIOR ART

A known second locking system, shown in FIG. 4B, can also be formed with a flexible tongue 11*i'* (fold lock) typically used at short edges 11', 12' as shown in FIG. 4B, which can be displaced during locking. Such a locking system can be locked with a vertical movement as shown in FIG. 3 where the first edge 11' of panel 10' is assembled to the second edge 12' of panel 30' by means of a vertical motion.

The displaceable tongue 11*i'* is configured to cooperate with the second tongue groove 12*j'* for locking in a vertical direction. The displaceable tongue 11*i'* is a separate part and is made of, e.g., plastic, and inserted in a displacement groove 11*k'* at the first edge 11' of the first panel 10'. The tongue 11*i'* is pushed into a displacement groove 11*k'* during a vertical assembling of the first and the second edge of the first and the second panel. The displaceable tongue 11*i'* springs back and into the second tongue groove 12*j'* at the second edge 12' of the panel 30' when the panels have reached a locked position.

A third 13' and a fourth edge 14' of the respective panels are provided with the first locking system, which enables assembling to an adjacent panel 20' by an angling movement to obtain a simultaneous assembling of the first 11' and the second 12' edges and the third 13' and the fourth edges 14' as shown in FIG. 3.

FIGS. 4A-B show cross sections of different embodiments of the known locking systems during assembling of a first and a second panel 10', 20'.

Exemplary embodiments of the invention are shown in FIGS. 5A-5C and FIGS. 6 through 11.

Figure 5A:
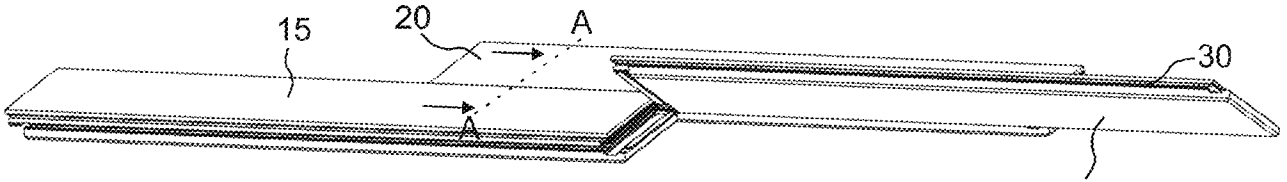
FIGS. 5A-5C show schematic illustrations a locking system according to embodiments of the invention.
Figure 5B:
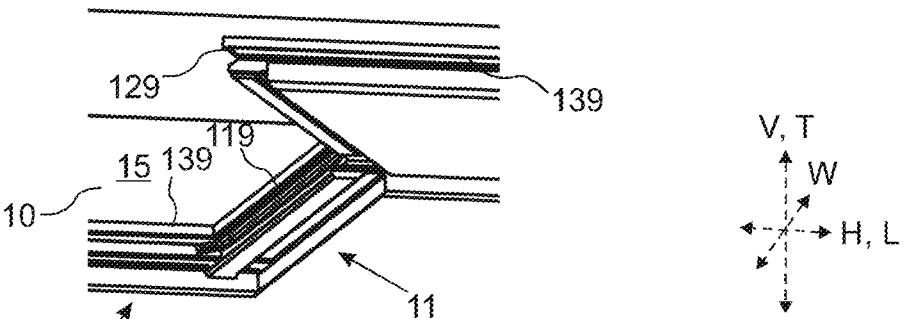
Figure 5C:
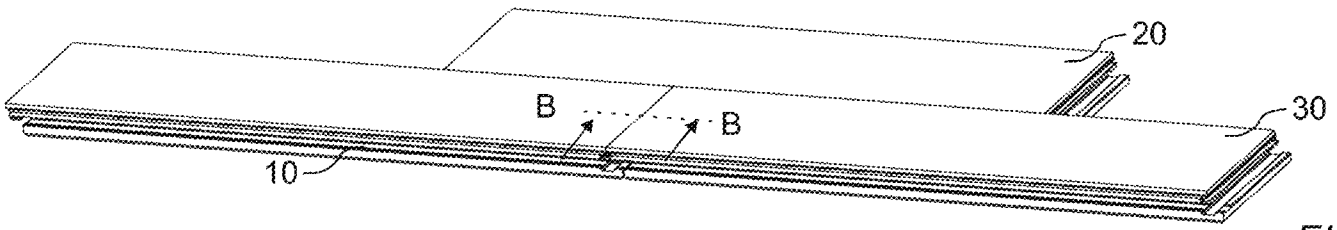
Figure 6:
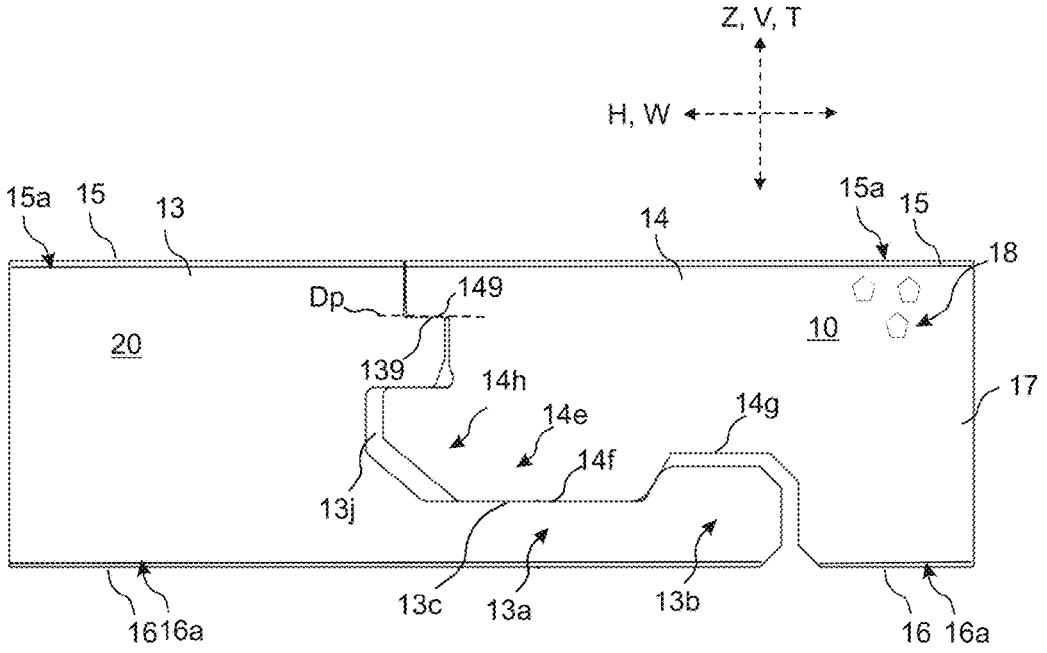
FIG. 6 shows a schematic cross-sectional view of the first locking system at the section A-A of FIG. 5A according to an embodiment of the disclosure.
Figure 7:
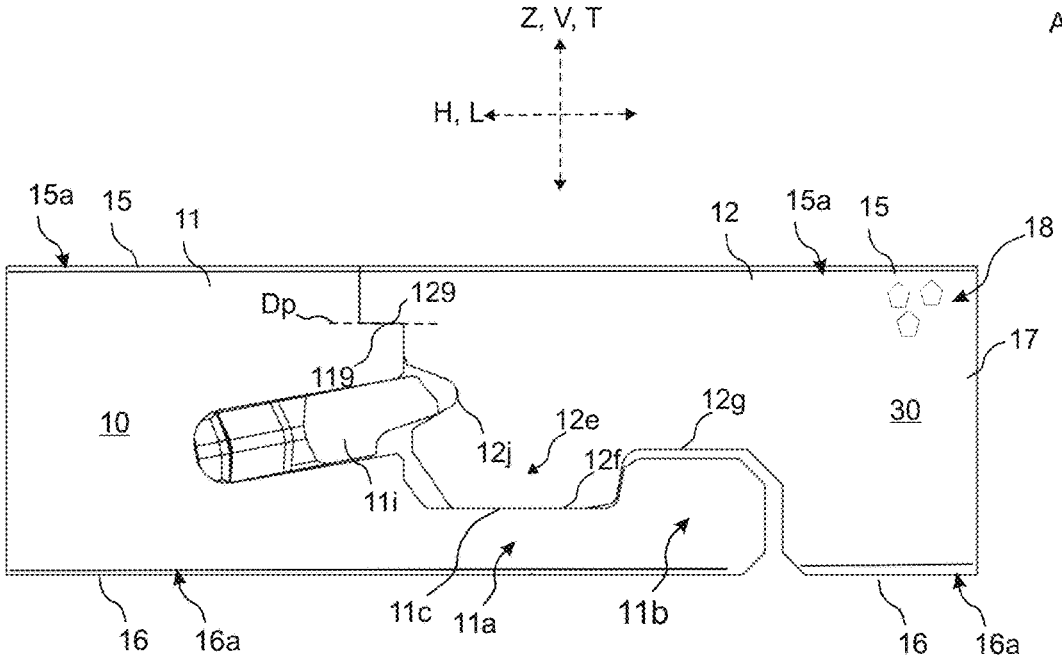
FIG. 7 shows a schematic cross-sectional view of the second locking system at the section B-B of FIG. 5C according to an embodiment of the disclosure.

Referring to FIGS. 5A-C, 6 and 7, a first mechanical locking system shown in FIG. 6 is formed with tongue 14*h* and groove 13*j* and configured to be assembled by means of an angling movement. The fourth edge 14 may comprise a first locking protrusion 14*e* in the shape of a locking tongue, provided with a first lower edge surface 14*f*. An embodiment of the second locking system is shown in FIG. 7, wherein the second edge 12 is provided with a second locking protrusion 12*e* which may be a locking tongue 12*h*, provided with a second lower edge surface 12*f*, preferably the first and second lower edge surfaces 12*f*, 14*f* are configured to cooperate with a respective of the first and second upper surfaces 11*c*, 13*c* of a first and a second locking strip 13*a*, 11*a* of adjacent panels, such as the second 20 panel shown in FIG. 6 and the third panel 30 as shown for instance in FIG. 7.

The first mechanical locking system may comprise a first tongue groove 13*j* at one of a third edge 13 or fourth 14 edge, for example the third edge 13, and a first locking tongue 14*h* at the other of the third or fourth edge, for example the fourth edge 14. The first locking tongue 14*h* and the first tongue groove 13*j* are configured to cooperate for locking of the third and the fourth edge 13, 14 in a vertical V direction. The first mechanical locking system may typically further comprise a first locking strip 13*a* at the third edge 13, provided with a vertically protruding first locking element 13*b*, a first locking groove 14*g* at a fourth edge 14. The first locking element 13*b* is configured to cooperate with the first locking groove 14*g* for locking of the third 13 and the fourth edge 14 in a horizontal direction, in particular away from each other and perpendicular said third and fourth edge.

The second mechanical locking system is preferably formed at one of a first 11 or second 12 short edge, such as a first edge, of similar, preferably essentially identical panels 10, 20, 30, 40, 50. The second mechanical locking system may be configured for locking the first edge 11 of the a first panel 10 to the second edge of an adjacent panel 30, in a plane, and in a vertical and/or in horizontal directions perpendicular said first and second edge towards and away from each other. An embodiment of the second mechanical locking system enables assembling of the first and the second panels by a vertical motion of the second edge of the adjacent panel 30 relative the first edge 11 of the first panel 10. Such vertical motion is shown for instance in FIGS. 10 and 11. The first and second mechanical locking systems are preferably formed by mechanical cutting, such as milling, drilling and/or sawing, of the edges of the panels and the second mechanical locking system may be provided with a displaceable tongue 11*i*, preferably of plastic. The displaceable tongue may be bendable and provided with protruding bendable parts, such as the displaceable tongues disclosed in WO2006/043893 and WO2007/015669. The displaceable tongue may also be configured to be locked by a movement along the first and the second edge, such as the displaceable tongues disclosed in WO2009/116926 and WO200/8004960.

Referring to FIG. 7. Embodiments of a second locking system may comprise a second locking tongue, which may be provided in the shape of a displaceable tongue 11*i* arranged in a displacement groove 11*k* for example at the first edge 11 of the first panel 10. The displaceable tongue 11*i* is configured to cooperate with a first tongue groove 12*j* formed at the other of the first 11 or second edge 12, for locking of the first and the second edge 11, 12 in a vertical V direction.

Figure 10:
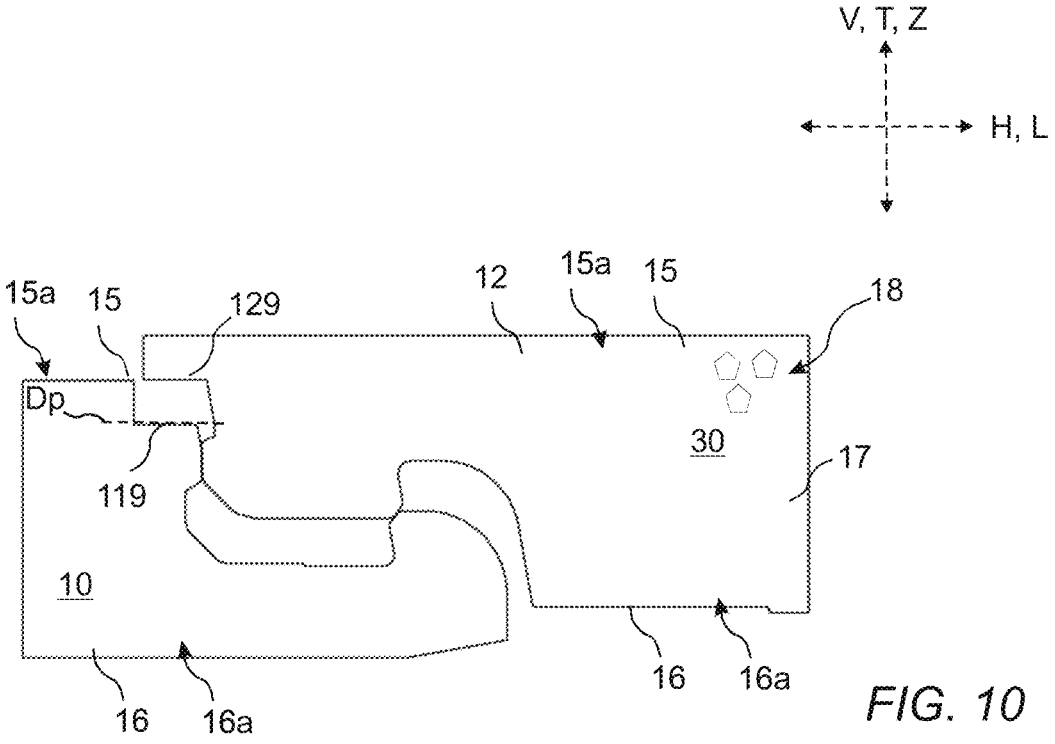
FIG. 10 shows a schematic illustration of the second locking system according to an embodiment being assembled by means of a vertical motion.
Figure 11:
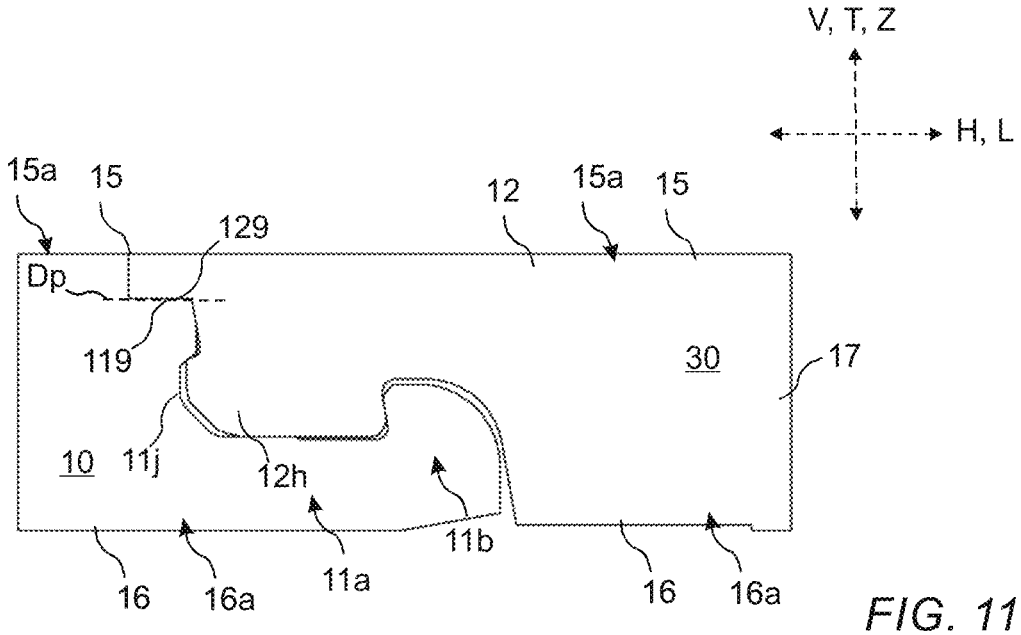
FIG. 11 shows a further schematic illustration of the second locking system of FIG. 10 being assembled by means of a vertical motion.

A further embodiment of the second locking system in shape of a one-piece solution combinable with the first locking system is shown in FIGS. 10 and 11.

As derivable from FIG. 6, an upper edge portion of one of a third or fourth edge 13, 14, which may be opposite parallel edges, such as the third edge 13, may comprise a planar surface portion, which may be provided in the shape of a first lower lip portion 139 configured to cooperate, including but not limited to, to receive or mate with a complementary planar surface portion, which may be provided in the shape of a first upper lip portion 149, of an upper edge portion of the other of the third or fourth edge of an adjacent panel.

As derivable from FIG. 7, an upper edge portion of one of a first or second edge 11, 12, which may be opposite parallel edges, such as the first edge 11, may comprise a planar surface portion, which may be in the shape of a second lower lip portion 119 configured to cooperate, including but not limited to, to receive or mate with a complementary planar surface portion, which may be provided in the shape of a second upper lip portion 129, of an upper edge portion of the other of the first or second edge of an adjacent panel.

An outermost portion of first upper lip portion 149 may be disposed inboard of outermost portion of first locking tongue 14*h*, as shown in FIG. 6.

An outermost portion of first lower lip portion 139 may be disposed inboard of outermost portion of first locking strip 13*a*, as shown in FIG. 6.

An outermost portion of first lower lip portion 139 may be disposed outboard of innermost portion of first tongue groove 13*j*, as shown in FIG. 6.

An upper edge portion of the fourth edge 14, preferably a long edge, may comprise a vertically extending edge portion extending from the front surface 15 followed by a bend, preferably a right-angle bend, inwards. Said bend followed by a horizontal planar surface, wherein said first upper lip portion 149 may comprise said horizontal planar surface. The vertically extending edge portion and the first upper lip portion may be perpendicular to each other, while the corner connecting the two portions may be rounded or beveled. Optionally, the horizontal planar surface may additionally form a datum surface. A datum surface may be a surface that contacts the adjacent panel, in locked position, and serves as a basis or guide to alignment of the panels to each other.

An upper edge portion of the third edge 13, preferably a long edge, may comprise a vertically extending edge portion extending from the front surface followed by a bend, preferably a right-angle bend, outwards. Said bend followed by a horizontal planar surface, wherein said first lower lip portion 139 may comprise said horizontal planar surface. The vertically extending edge portion and the first lower lip portion may be perpendicular to each other, while the corner connecting the two portions may be rounded. Optionally, the horizontal planar surface may additionally form a datum surface.

An upper edge portion of the second edge 12, preferably a short edge, may comprise a vertically extending edge portion extending from the front surface 15 followed by a bend, preferably a right-angle bend, inwards. Said bend followed by a horizontal planar surface, wherein said second upper lip portion 129 may comprise said horizontal planar surface. The vertically extending edge portion and the second upper lip portion may be perpendicular to each other, while the corner connecting the two portions may be rounded or beveled. Optionally, the horizontal planar surface may additionally form a datum surface.

An upper edge portion of the first edge 11, preferably a short edge, may comprise a vertically extending edge portion extending from the front surface 15 followed by a bend, preferably a right-angle bend, outwards. Said bend followed by a horizontal planar surface, wherein said second lower lip portion 119 may comprise said horizontal planar surface. The vertically extending edge portion and the second lower lip portion may be perpendicular to each other, while the corner connecting the two portions may be rounded. Optionally, the horizontal planar surface may additionally form a datum surface.

Outermost portion of second lower lip portion 119 may be disposed inboard of an outermost portion of second locking strip 11*a*, as shown in FIG. 7.

The second lower lip portion 119 may have an extension inboard of an innermost portion of the second tongue groove 11*j*, as shown in FIG. 11.

The second upper lip portion 129 may have an extension outboard of an outermost portion of the second locking tongue 12*h*, as shown in FIG. 10.

An outermost portion of second lower lip portion 119 may be disposed inboard of outermost portion of second locking tongue 11*i*, as shown in FIG. 7.

An outermost portion of second lower lip portion 119 may be disposed at least partially inboard of an opening of the second displacement groove 11*k*, as shown in FIG. 7.

Inboard may be synonymous with inwards of, in a direction towards the centre of the panel. Outboard may be synonymous with outwards of, in a direction away from the centre of the panel.

The upper and lower lips may each comprise a datum surface configured for aligning the front surface 15 of the panel with respective front surfaces 15 of adjacent panels to become flush with each other when assembled in the locking position.

The upper and lower lips may be planar, in particular the lip portions may be planar and may extend in parallel. The lip portions may preferably extend in a plane parallel the front surface 15 of the panel. However, other configurations are perceivable, such as inclined in relation to the front surface 15.

The first upper lip portion 149 of the panel may be configured to bear and/or rest on the first lower lip portion 139 when adjacent panels are assembled in locking engagement. Thereby, improved sealing function is facilitated when the panel is assembled in the locking position to one or more further panels by means of the first locking system.

The second upper lip portion 129 of the panel may be configured to bear and/or rest on the second lower lip portion 119 when adjacent panels are assembled in locking engagement. Thereby, improved sealing function is facilitated when the panel is assembled in the locking position to one or more further panels by means of the second locking system.

The first and second lower lip portions 119, 139 may form a continuous right-angle with each other. The first and second upper lip portions 129, 149 may form the shape of a continuous right-angle with each other. The continuous right-angles may extend around respective diagonally opposite corners of the panel. The first and second lower and upper lip portions may form the shape of a continuous rectangle. The rectangle may extend along a circumference of the panel as shown in FIG. 5A.

The first and second lower lip portions 119, 139 may be configured to be underlying when engaging with a respective upper lip portion 129, 149. The first and second upper lip portions 129, 149 may be configured to be overlying when engaging with a respective lower lip portion 119, 139.

Accordingly, at least a portion of the lower lip portions 119, 139 may face in a direction upwards and at least a portion of the upper lip portions 129, 149 may face in a direction downwards.

The first edge 11 and the third edge 13 may each comprise a vertically extending surface extending from the front surface 15 of the panel. The lower lip portions 119, 139 may in combination with the respective vertically extending surface form an inwards recessing shape, such as right-angled surface which recesses inwards.

The second edge 12 and the fourth edge 14 may each comprise a vertically extending surface extending from the front surface 15 of the panel. The upper lip portions 129, 149 may in combination with the respective vertically extending surface form an outwards recessing shape, such as a right-angled surface which complements the respective inwards recessing lower lip portions, as shown in FIGS. 6-11.

The respective upper and/or lower lip portions may comprise a material which facilitates sealing, including, but not limited to, a polymer, rubber, silicone, adhesives, vax or like.

In a preferred embodiment, the respective first and second lower lip portions 119 and 139 are provided on the short first edge 11 and the long third edge 13 of the panel 10, and the respective first and second upper lip portions 129, 149 are provided on the short second edge 12 and the long fourth edge 14 respectively, as shown for instance in FIGS. 6, 7, 10 and 11.

Accordingly, by courtesy of that the respective first and second upper lip portions 129, 149 may cooperate with, including to bear on, the respective first and second lower lip portions 119, 139, the configuration may bring about the technical advantage that the weight of the panel urges the respective first and second upper lip portions 129, 149 towards the respective first and second lower lip portions 119, 139 thereby the weight of the panel may contribute to the sealing function and thus improved sealing may be facilitated.

This entails that in some embodiments, the first lower edge surface 14*f* and the first upper surface 13*c* of two adjacent panel may in some embodiments not abut each other when the two adjacent panels are in assembled in the locking position. Thus, a gap may extend between at least part of the first lower edge surface 14*f* and the first upper surface 13*c* of two adjacent panels when assembled in the locking position.

However, in some embodiments, the first lower edge surface 14*f* and the first upper surface 13*c* of two adjacent panel may abut each other when the two adjacent panels are in assembled in the locking position by means of the first locking system.

Referring to FIG. 6, the first locking tongue 14*h*, the first tongue groove 13*j* and the first lip portions 139, 149 may be configured to bias the first upper lip portion 149 towards the first lower lip portion 139 when a respective third edge 13 and fourth edge 14 are assembled in the locking position. This configuration may facilitate that the first upper lip portion 149 is always biased towards the first lower lip portion 139 when one or more panels are assembled in the locking position.

The first locking system may comprise a first locking tongue 14*h* and a first tongue groove 13*j*. The first lower lip portion 139 is preferably disposed between the first tongue groove 13*j* and the front surface 15 of the panel. The first upper lip portion 149 is preferably disposed between the first locking tongue 14*h* and the front surface 15 of the panel.

Referring to FIG. 7, one of the first or second edge 11, 12, for example the first edge 11 may in some embodiments comprise a displaceable, preferably flexible tongue 11*i* configured to enable assembling of panels by means of vertical folding. The displaceable tongue 11*i* may be configured to cooperate with the second tongue groove 12*j* to thereby bias the second upper lip portion 129 against the second lower lip portion 119, thereby facilitating an improved sealing function.

The second locking system may comprise a second locking tongue 11*i*, 12*h* and a second tongue groove 12*j*, 11*j*. The second lower lip portion 119 is preferably disposed between the second tongue groove 12*j*, 11*j* and the front surface 15 of the panel. The second upper lip portion 129 is preferably disposed between the second locking tongue 11*i*, 12*h* and the front surface 15 of the panel.

As derivable for instance from FIGS. 6-11, the provision of a pair of lip portions, such as the first lower and upper lip portions 139, 149 and/or the second lower and upper lip portions 119, 129, each pair 119, 129; 139, 149 may respectively form a mechanical labyrinth seal. Thus, this configuration may particularly advantageous for preventing moisture penetration between the edges 11, 12 and/or between edges 13, 14 respectively, such as between the front surface 15 to the locking tongue 11*i*, 12*h* or 14*h* or tongue groove 11*j*, 12*j*, 13*j* or from the front surface 15 to the rear surface 16.

Figure 8:
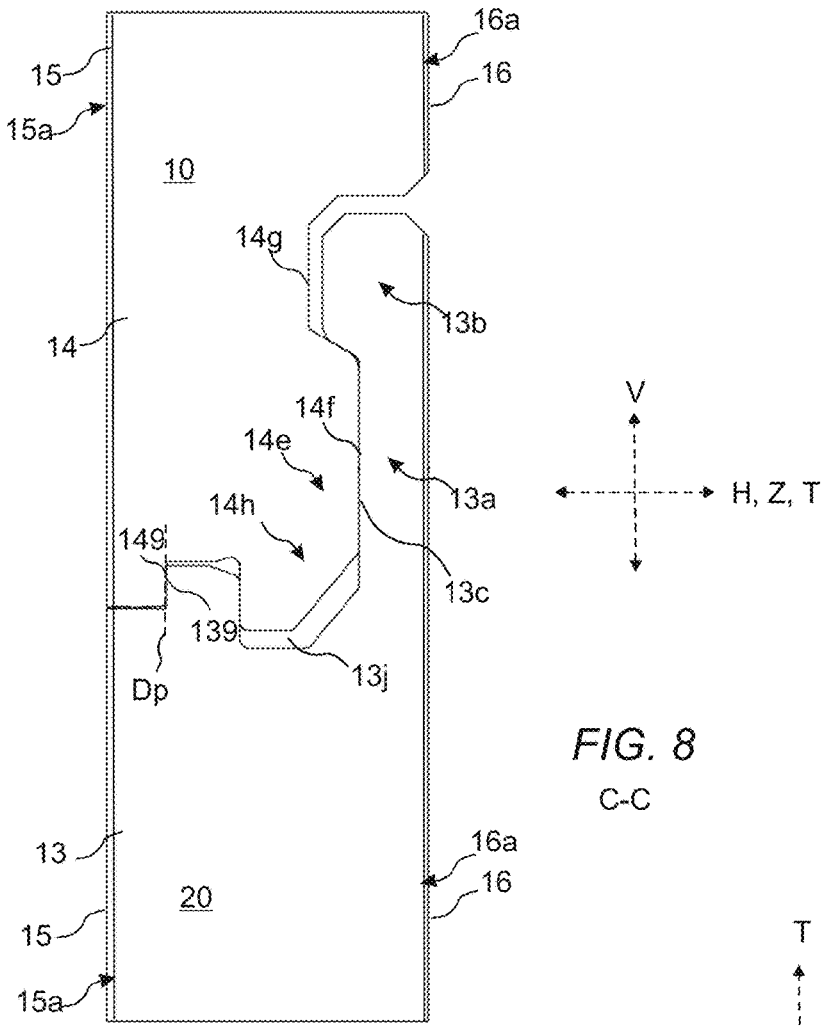
FIG. 8 is a schematic cross-sectional view of the first locking system at the section C-C of FIG. 12 according to an embodiment assembled as a wall.
Figure 12:
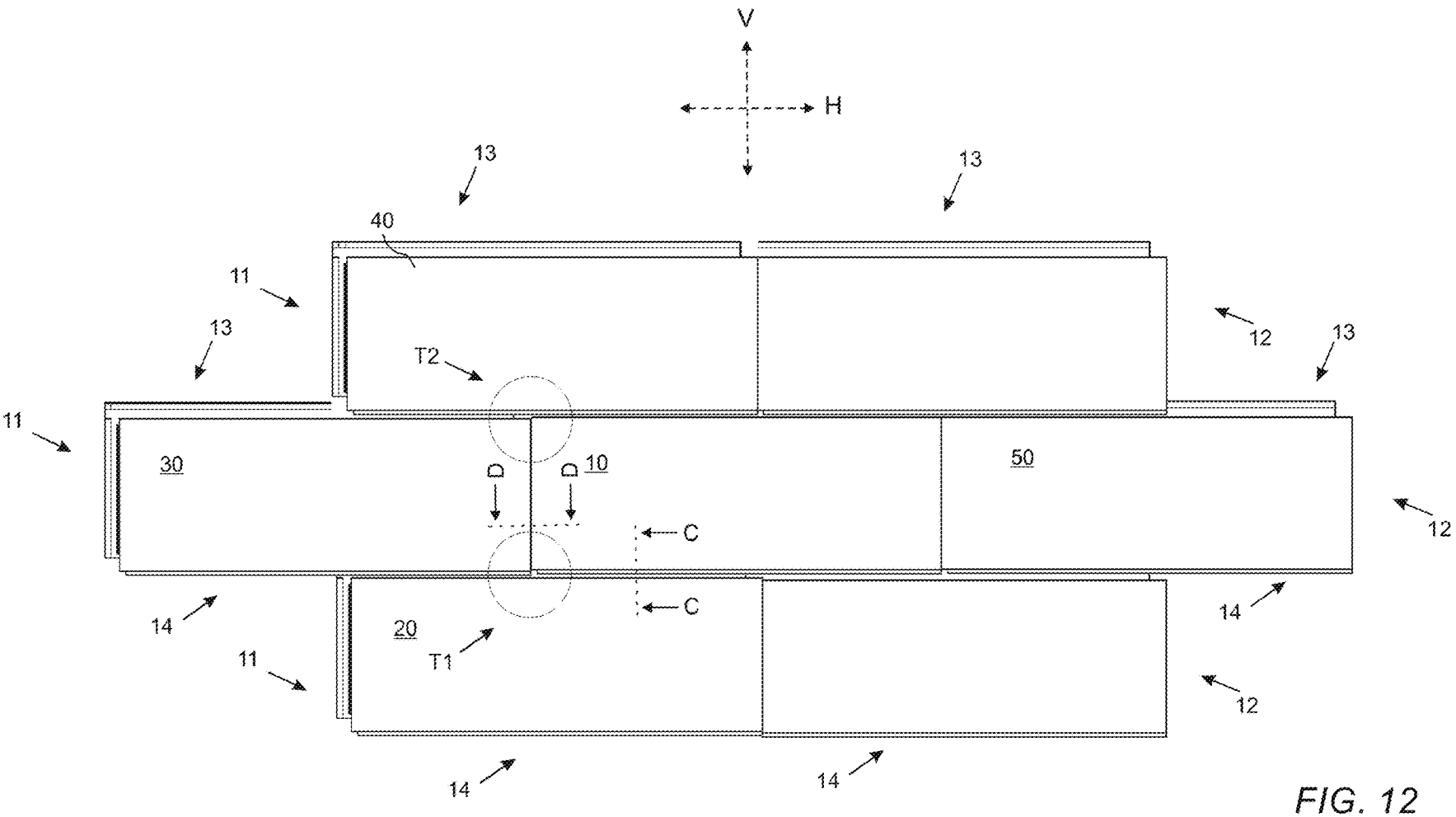
FIG. 12 is a schematic illustration of an exemplary embodiment assembled as a wall.

Referring to FIG. 8 and FIG. 12 showing an exemplary embodiment where the panels are assembled as a wall, i.e., the panels are utilized as wall panels. The provision of the lip portions 119, 129 139, 149 between the locking tongue 11*i*, 12*h*, 14*h* and/or locking groove 11*j*, 12*j*, 13*j* and the front surface 15 may facilitate that one or more of the pair of lip portions, i.e., 119, 129; 139, 149, may provide mechanical obstacles, e.g., for a fluid such as water. Thereby, a fluid such as water which flow along the front surface 15 in a vertically downwards direction, when acted upon by gravitational force, may be hindered from flowing passed the lip portions, such as the first lower lip portion 139 in a direction from the front surface 15 to the rear surface 16.

In particular the first lower lip portion 139, may provide, e.g. for a fluid such as water, a mechanical obstacle extending in a direction counter the direction of the gravitational force. Thereby, a fluid such as water which flow along the front surface 15 in a vertically downwards direction, when acted upon by gravitational force, will be hindered from flowing upwards and over the first lower lip portion 139.

The first lower lip portion 139 and the first upper lip portion 149 may respectively define a datum plane Dp as illustrated in FIG. 6.

The first lower lip portion 139 and the first upper lip portion 149 may mutually define a datum plane Dp as illustrated in FIG. 10.

The second lower lip portion 119 and the second upper lip portion 129 may respectively define a datum plane Dp as illustrated in FIG. 7.

The second lower lip portion 119 and the second upper lip portion 129 may mutually define a datum plane Dp as illustrated in FIG. 11.

The first, second, third and fourth lip portions 119, 129, 139, 149 may be configured to define a datum plane Dp.

The first, second, third and fourth lip portions 119, 129, 139, 149 may essentially extend in a common plane, which may be the datum plane Dp.

The datum plane Dp may facilitate alignment of the respective front surface 15 of adjacent panels when assembled in the locking position such that the respective front surfaces 15 of adjacent panels are arranged flush with each other.

The first lower lip portion 139 may preferably be disposed between first tongue groove 13*j* and the front surface 15 of the panel. The first upper lip portion 149 may preferably be disposed between first locking tongue 14*h* and the front surface 15 of the panel.

As explained above and shown in FIG. 7, one of the first or second edges may according to embodiments comprise a second locking tongue 11*i*, such as a displaceable locking tongue configured to linearly translate in a displacement groove 11*k*, and the other of the first and second edges comprises a second tongue groove 12*j* for receiving said second locking tongue.

The second lower lip portion 119 may preferably be disposed at a vertical V position between second locking tongue 11*i* and the front surface 15 of the panel. The second upper lip portion 129 may preferably be disposed at a vertical V position between second tongue groove 12*j* and the front surface 15 of the panel.

Alternatively, as shown in FIGS. 10 and 11, the second lower lip portion 119 may be disposed at a vertical V position between a second tongue groove 11*j* of the first edge 11 and the front surface 15 of the panel. The second upper lip portion 129 may be disposed at a vertical V position between a second tongue 12*h* of the second edge 12 and the front surface 15 of the panel.

The first lower lip portion 139 may be contiguous with the second lower lip portion 119.

The first upper lip portion 149 may be contiguous with, preferably continuous with, the second upper lip portion 129.

The lip portions 119, 129, 139, 149 may be contiguous with each other such as to extend continuously along the first, second, third and fourth edges.

Courtesy to the lip portions 119, 129, 139, 149 being overlaying and underlying respectively in a complementary manner, they may continuously define the datum plane Dp along the first, second, third and fourth edges when a panel is assembled with similar panels in the locking position along all edges 11, 12, 13, 14. Thereby, improved sealing may be facilitated.

The function of the lip portions may thus be twofold; having the function of aligning the respective front surfaces of the panels and/or providing the continuous seal along the circumference of the panel together with respective mating lip portions of adjacent panels when assembled in the locking position on all four edges of the panel.

The lip portions may be formed contiguous with each other to thereby continuously define the datum plane Dp along the circumference of the panel. It is thereby achieved that when a panel is assembled in the locking position with further essentially similar panels along all four edges, there is obtained continuous contact provided by mating or closed lip portions 119, 129; 139, 149 along essentially the entire, or the entire, circumference of the panel. A continuous seal along the circumference of the panel may thus be facilitated.

Referring to FIG. 7, preferably, the edges of the panel which comprises a locking strip may comprise a respective lower lip portion i.e. the first edge 11 and the third edge 13.

Referring e.g. to FIGS. 6-7 and 10-11, preferably, the edges of the panel which comprises a locking strip may comprise a respective lower lip portion i.e. the first edge 11 and the third edge 13.

The panel 10 may comprise a surface layer 15*a* provided at the front surface 15 and preferably a backing layer 16*a* provided at the rear surface 16. Typically, the surface layer comprises a decorative layer configured to be visible when the panels are assembled to a flooring. Such decorative layer is well known in the art and may be provided in different forms, including but not limited to printed paper, powder, printed powder or veneer, such as wood veneer. The surface layer, which may also provide a protective layer, typically comprising a binder resin, such as a thermosetting resin, which facilitates bonding, i.e., adhesion between, i.a., the decorative layer and the core of the panel. The binder may also facilitate bonding of one or more additives such as surface hardening particles and/or pigments in order to provide the surface layer with various properties. The binder may comprise for example Melamine Formaldehyde. The binder may penetrate into the core of the panel during manufacture of the panel, typically the binder is provided in powder form whereby it becomes liquid in response to exposure to heat. The binder may therefore penetrate into the core of the building panel. The core may for example comprise one of MDF, HDF, wood, stone, ceramics, PVC, plastics, but other materials are contemplatable.

The binder may have a depth of penetration into the core of the panel, in the thickness direction Z, from the front surface 15 of the panel and into the core. This feature provides for improved sealing between the respective upper and lower lip portions.

The depth of penetration may be at least into the first lower and upper lip portions 139, 149. This provides for a more water-tight first locking system.

The depth of penetration may be at least into the second lower and upper lip portions 119, 129. This provides for a more water-tight second locking system.

Consequently, aspects of the present disclosure may be particularly suitable for use in wet spaces, such as bath rooms, kitchens or like.

Consequently, aspects of the present disclosure may be suitable for use as floor panels, as illustrated for instance in FIGS. 6-7, 10-11 and 13.

Figure 9:
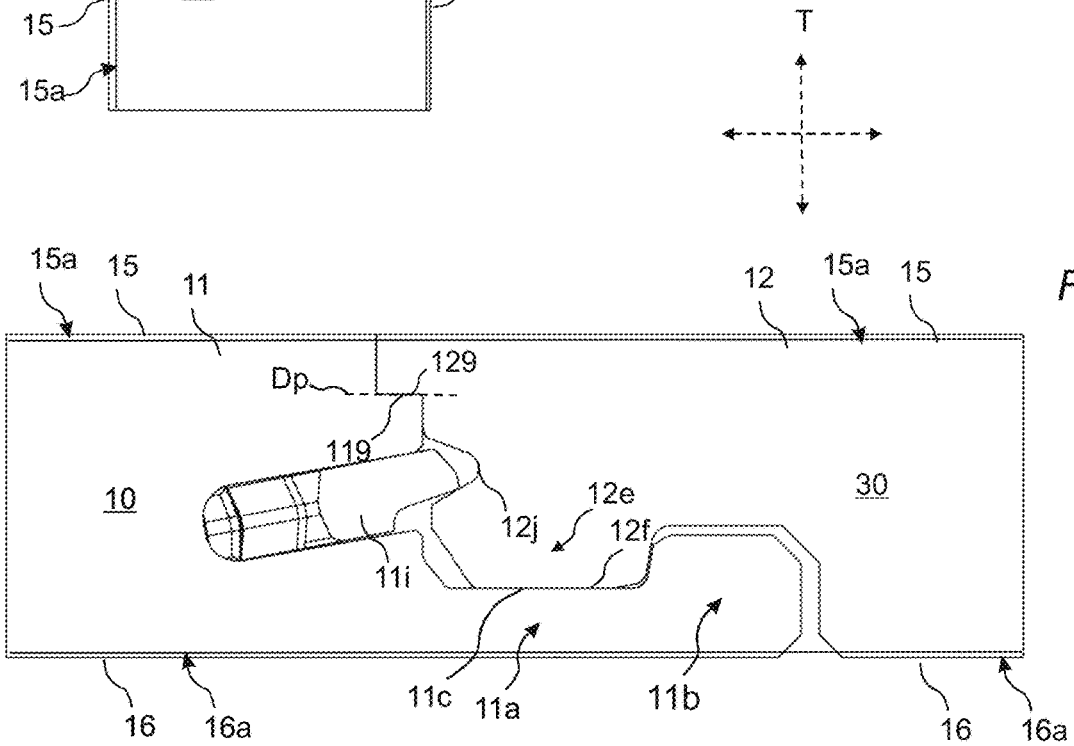
FIG. 9 is a schematic cross-sectional view of the first locking system at the section D-D of FIG. 12 according to an embodiment assembled as a wall.

Consequently, aspects of the present disclosure may be suitable for use as wall panels, as illustrated for instance in FIGS. 8-9 and 12.

It should be appreciated that the provision and configuration of the upper and lower lip portions 119, 129, 139, 149, as described herein, in particular configured to continuously extend along all the edges of a panel, is not limited to use in combination with a particular locking system, but may rather be implemented in combination with virtually any mechanical locking system and in building panels of any material. The above: described locking system serving merely as exemplary embodiments of possible implementation forms.

Figure 13:
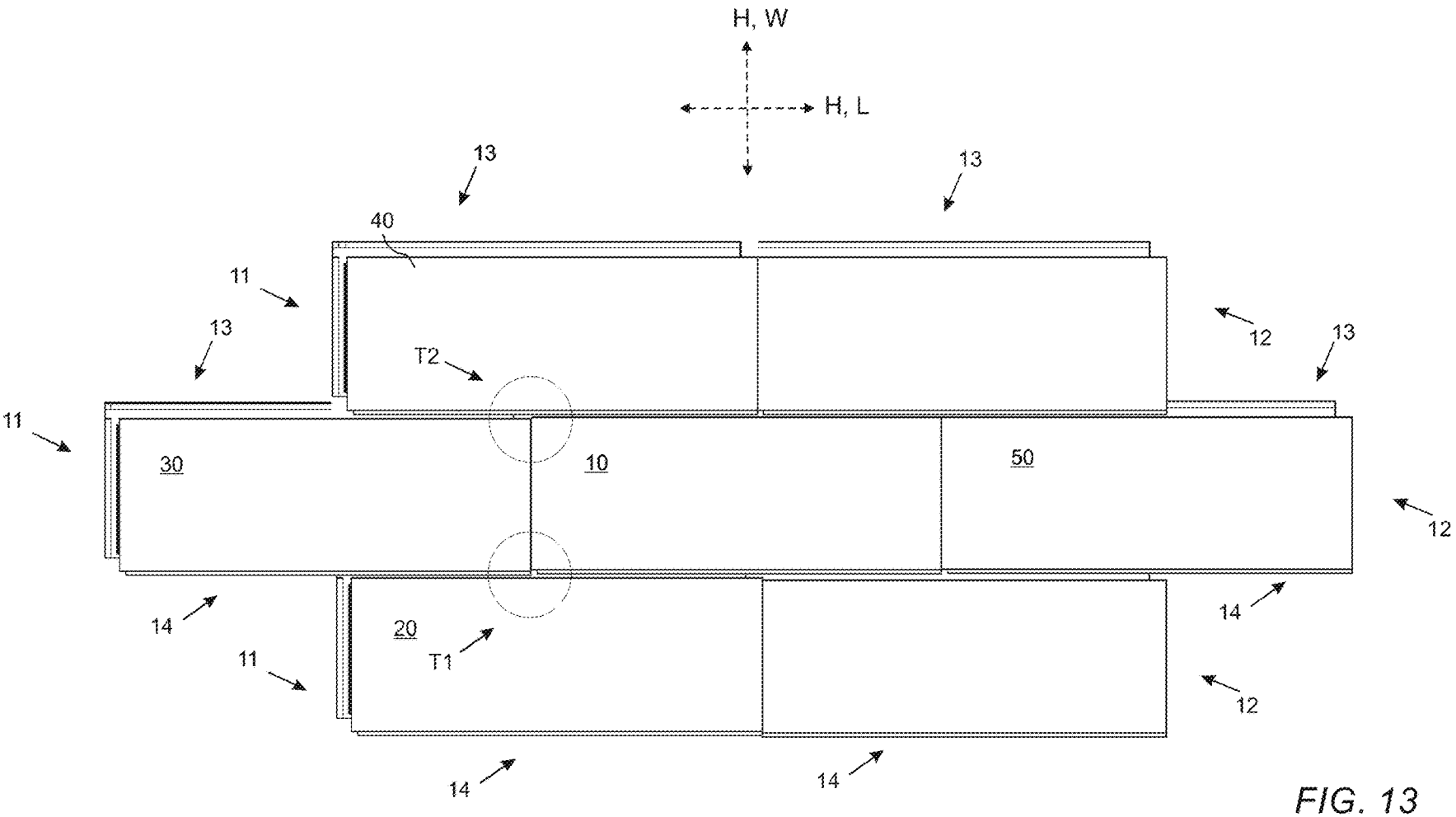
FIG. 13 is a schematic illustration of an exemplary embodiment assembled as a floor.
Figure 14A:
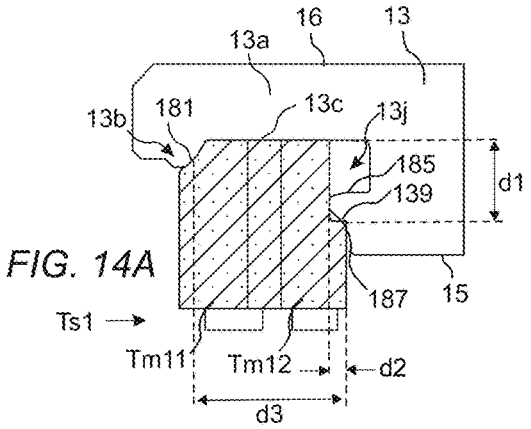
FIG. 14A is a schematic illustration of a first tool set and an edge portion of a panel according to an embodiment.
Figure 15A:
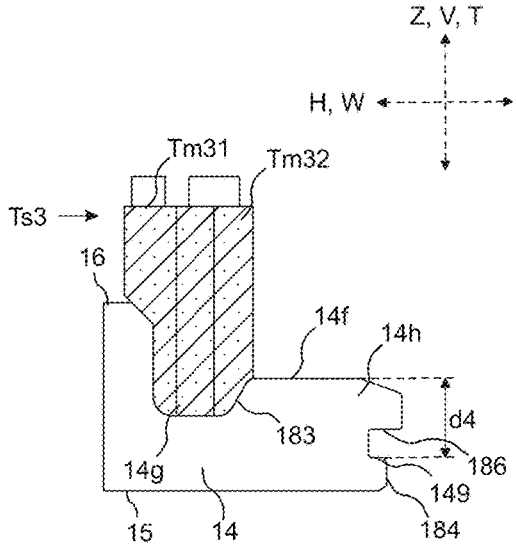
FIG. 15A is a schematic illustration of a third tool set and an edge portion of a panel according to an embodiment.
Figure 14B:
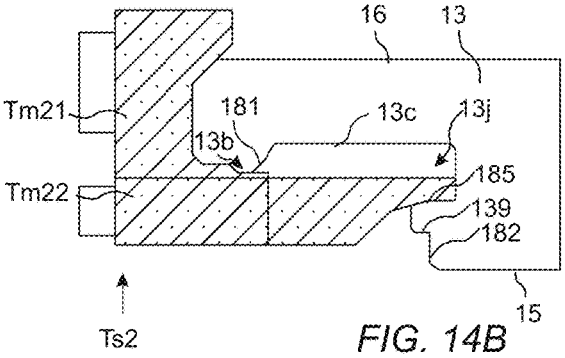
FIG. 14B is a schematic illustration of a second tool set and an edge portion of a panel according to an embodiment.
Figure 15B:
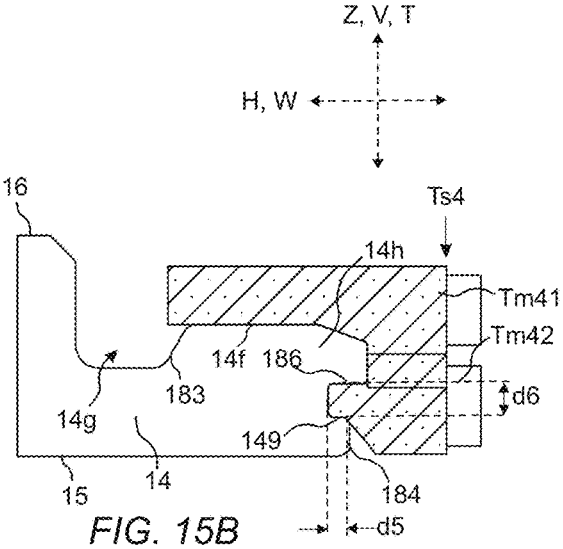
FIG. 15B is a schematic illustration of a fourth tool set and an edge portion of a panel according to an embodiment.
Figure 16A:
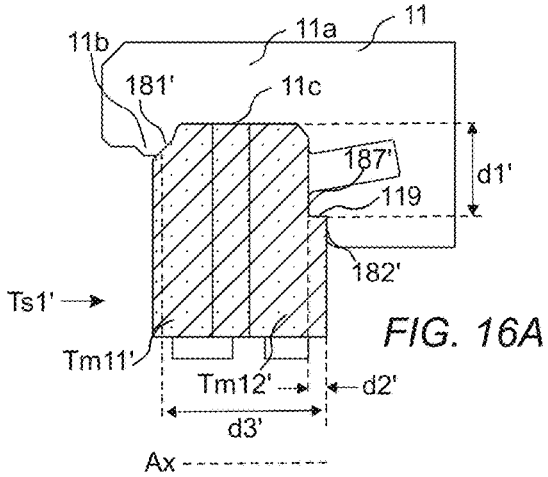
FIG. 16A is a schematic illustration of a first tool set and an edge portion of a panel according to an embodiment.
Figure 16B:
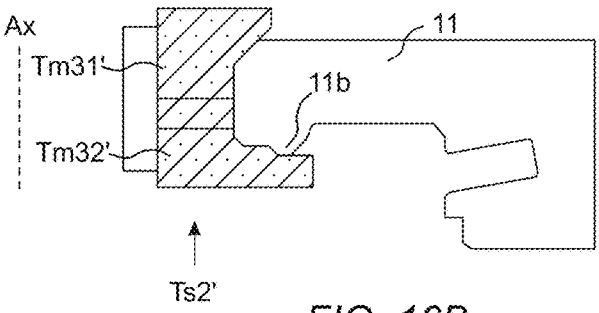
FIG. 16B is a schematic illustration of a second tool set and an edge portion of a panel according to an embodiment.

Referring to FIGS. 12-13, a panel, such as the first panel 10 may be assembled to an adjacent second panel 20 along its long fourth edge 14 by means of the first locking system, e.g. by an angling motion, thereby creating a long-side to long-side joint. The panel 10 may be further assembled with one of its short edges 11 to an adjacent third panel 30 by means of the second locking system, e.g., by vertical folding, thereby creating a short-side to short-side joint, and further assembled with its long third edge 13 to a further fourth panel 40 by means of the first locking system, e.g. by an angling motion, thereby creating a further long-side to long-side joint. The two further panels 20, 40 being arranged on opposite sides of the short-side joint. The resulting configuration of panels is a typical floor lay when assembling e.g. a floating floor as shown in FIG. 13 or a wall, as shown in FIG. 12. As derivable, the configuration comprises two T-joints. Each T-joint comprising a long-side to long-side joint (between a third edge 13 and a fourth edge 14) and a short-side to short-side joint (between a first edge 11 and a second edge 12). Thus, the set of similar or essentially identical panels can be assembled in the locking position to comprise a first T-joint T1 and a second T-joint T2, as shown for instance in FIG. 13.

In order to improve the sealing between assembled lay of panels comprising a panel assembled in the locking position on all four sides i.e. all four edges, such as a floor lay (see FIG. 13), it would be desirable to improve the water protection of both T-joints.

Thanks to the building panel having the features set forth herein, and in the appended claims, it may be facilitated that the sealing of both T-joints T1 and T2 is improved.

FIGS. 14A-14B, FIGS. 15A-15B, FIGS. 16A-16B and FIGS. 17A-17B show schematic illustrations of a method of producing mechanical locking systems in a panel, such as a floor panel or wall panel.

FIGS. 14A-14B, FIG. 15A-15B shows details of a first mechanical locking system at opposite third and fourth edges 13, 14, such as long edges. The mechanical locking system may comprise a first pair of horizontal locking surfaces 181, 182 in the third edge 13 and a second pair of horizontal locking surfaces 183, 184 in the fourth edge 14 for horizontal locking of adjacent panels.

The first pair of horizontal locking surfaces comprises a first upper edge surface 182 of the panel and a locking element surface 181 provided on a locking element 13*b* protruding from a locking strip 13*a*.

The second pair of horizontal locking surfaces may comprise a second upper edge surface 184 at the fourth edge 14 and a locking groove surface 183 provided on a locking groove 14*g*, the locking element configured to receive a locking element 13*b* of an adjacent panel in response to a folding movement of the adjacent panel for horizontal locking of the panels from parting away from each other.

A second mechanical locking system may be provided at respective parallel and opposite first and second edges 11, 12, such as short edges, is shown in FIGS. 16A-16B and FIGS. 17A-17B. The second mechanical locking system may be configured to cooperate for horizontal and vertical locking of two adjacent building panels, preferably by means of a vertical motion, such as vertical folding.

A first pair of vertical locking surfaces 139, 185 may be provided in the third edge 13 and a second pair of vertical locking surfaces 149, 186 may be provided in the fourth edge 14 for vertical locking of adjacent panels.

The first pair of vertical locking surfaces 139, 185 comprising a first lower lip portion 139 disposed below said first upper edge surface 182 and a tongue groove surface 185 provided by a tongue groove 13*j* configured to receive a locking tongue 14*h* of a fourth edge 14 of an adjacent panel for vertical locking of the adjacent panel in a direction along the normal of a front surface 15 of the panel.

The second pair of vertical locking surfaces 149, 186 comprises an upper surface 186 of the locking tongue 14*h* and a first upper lip portion 149 disposed between a front surface 15 of the panel and the locking tongue 14*h* and below a second upper edge surface 184.

The first lower lip portion 139 may be configured to cooperate with the first upper lip portion 149 provided below the second upper edge surface 184 of an adjacent panel for vertical locking of the panels when said third and fourth edges are assembled in the locking position.

The method may comprise displacing the floor panel in a feeding direction FD with its third edge 13 relative a first tool set TS1.

The method may comprise displacing the floor panel in a feeding direction FD with its third edge 13 relative a second tool set TS2.

The first tool set (TS1) may comprise a first and second tool member TM11, TM12 arranged on a common rotary shaft. The second tool set TS2 may comprises a first and second tool member TM21, TM22 arranged on a common rotary shaft.

Forming by the first tool set TS1, preferably the first tool member TM11, at least part of the locking element 13*b* and preferably at least part of the locking strip 13*a*. The forming at least part of the locking element 13*b* may comprise forming at least part of the locking element surface 181.

Forming with the first tool set TS1, preferably the second tool member TM12, at least part of locking strip 13*a*.

Forming with the first tool set TS1, preferably the second tool member TM12, at least part of first upper edge surface 182.

Forming with the first tool set TS1, preferably the second tool member TM12, at least part of the first lower lip portion 139.

Forming with the second tool set TS2, preferably the first tool member TM21, at least a part of the locking element 13*b*.

Forming with the second tool set TS2, preferably the second tool member TM22, at least part of the tongue groove 13*j*. The forming at least part of the tongue groove 13*j* may comprise forming at least part of the tongue groove surface 185.

The method may further comprise displacing the floor panel in a feeding direction FD with its fourth edge 14 relative a third tool set TS3.

The method may further comprise displacing the floor panel in a feeding direction FD with its fourth edge 14 relative a fourth tool set TS4.

TS1 may be arranged upstream TS2 in the feeding direction. TS3 may be arranged upstream TS4 in the feeding direction.

The third tool set TS3 may comprise a first and second tool member TM31, TM32 arranged on a common rotary shaft. The fourth tool set TS4 may comprise a first and second tool member TM41, TM42 arranged on a common rotary shaft.

The method may further comprise forming with the third tool set TS3 at least part of the locking groove 14*g*, wherein forming at least part of the locking groove 14*g* may comprise forming at least part of the locking groove surface 183.

Forming with the fourth tool set TS4, preferably the first tool member TM41, at least part of the locking tongue 14*h*.

Forming with the fourth tool set TS4, preferably the second tool member TM42, at least part of the locking tongue 14*h*, wherein forming at least part of the locking tongue 14*h* may comprise forming at least part of the upper tongue surface 186.

Forming with the fourth tool set TS4, preferably the first tool member TM41 at least part of the first upper lip portion 149.

The first tool members and the second tool members TM11, TM12; TM21, TM22; TM31, TM32; TM41, TM42 of a respective tool set TS1, TS2, TS3, TS4 may each comprise a rotatable disk or rotatable cutting tool configured to be adjustable in relation to each other, preferably in a direction long a centre axis Ax of the common rotary shaft.

The rotatable discs or rotatable cutting tools of each tool set may be configured to be at least partially overlapping in a direction along a centre axis Ax of the common rotary shaft.

The first tool set TS1 and the third tool set TS3 may be arranged opposing each other on opposite sides of the panel, in a width direction W of the panel, and configured to simultaneously engage with the panel.

The second tool set TS2 and the fourth tool set TS4 may be arranged opposing each other on opposite sides of the panel, in a width direction W of the panel, and configured to simultaneously engage with the panel.

Referring to FIGS. 16A-16B and FIGS. 17A-17B, the method may further comprise one or more of the steps of:

Displacing the floor panel in a feeding direction FD with its first edge 11 relative a first tool set TS1' and relative a second tool set TS2'.

The first tool set TS1' may comprise a first and second tool member TM11', TM12' arranged on a common rotary shaft. The second tool set TS2' may comprise a first and second tool member TM21', TM22' arranged on a common rotary shaft.

Forming by the first tool set TS1', preferably the first tool member TM11', at least part of the locking element 11*b* and at least part of the locking strip 11*a*, wherein forming at least part of the locking element 11*b* comprises forming at least part of the locking element surface 181'.

Forming with the first tool set TS1', preferably the second tool member TM12', at least part of locking strip 11*a*, the first upper edge surface 182' and the second lower lip portion 119.

Forming with the second tool set TS2', preferably the first tool member TM21, at least a part of the locking element 11*b*.

Figure 17A:
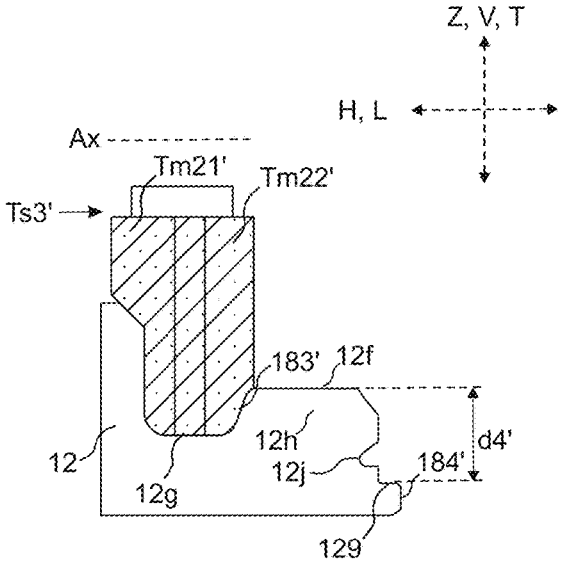
FIG. 17A is a schematic illustration of a third tool set and an edge portion of a panel according to an embodiment.
Figure 17B:
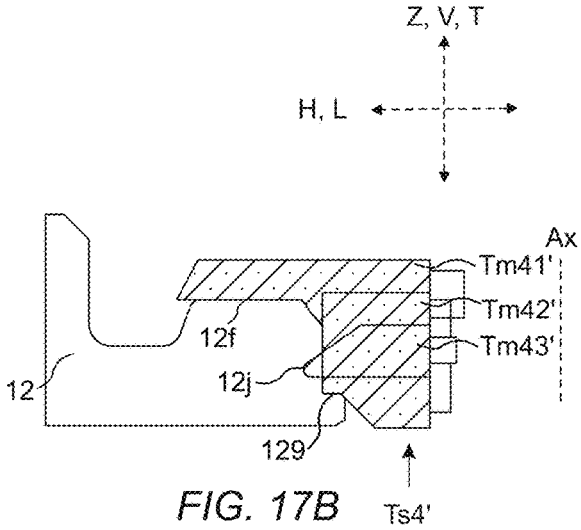
FIG. 17B is a schematic illustration of a fourth tool set and an edge portion of a panel according to an embodiment.

In addition, the method may preferably comprise: displacing the floor panel in a feeding direction FD with its second edge 12 relative a third tool set TS3' and a fourth tool set TS4'. The third tool set TS3') optionally comprising a first and second tool member TM31', TM32' arranged on a common rotary shaft. The fourth tool set TS4' may comprise a first, second and third tool member TM41', TM42', TM43' arranged on a common rotary shaft as shown in FIG. 17B.

Forming with the third tool set TS3' at least part of the locking groove 12*g*, wherein forming at least part of the locking groove 12*g* comprises forming at least part of the locking groove surface 183'.

Forming with the fourth tool set TS4', preferably the first tool member TM41, at least part of the second locking tongue 14*h*, wherein forming of at least part of the locking tongue 12*h* comprises forming at least part of a lower surface 12*f* of the locking tongue 12*h*.

Forming with the fourth tool set TS4', preferably the second tool member TM42', at least part of the locking tongue 12*h* and at least part of the first upper lip portion 149.

Forming with the fourth tool set TS4', preferably the third tool member TM43', at least part of a tongue groove 12*j* configured to receive a displaceable locking tongue of a first edge 11 of an adjacent panel for vertical locking of panels.

The first, second and third tool members TM11', TM12'; TM21', TM22'; TM31', TM32'; TM41', TM42', TM43' of a respective tool set TS1', TS2', TS3', TS4' may each comprise a rotatable disk or rotatable cutting tool configured to be adjustable in relation to each other, preferably in a direction long a centre axis Ax of the common rotary shaft.

The rotatable discs or rotatable cutting tools of each tool set may be configured to be least partially overlapping in a direction along a centre axis Ax of the common rotary shaft.

The first tool set TS1' and the third tool set TS3' may be arranged opposing each other on opposite sides of the panel, in a longitudinal direction L of the panel, and configured to simultaneously engage with the panel.

The second tool set TS2' and the fourth tool set TS4' may be arranged opposing each other on opposite sides of the panel, in a longitudinal direction L of the panel, and configured to simultaneously engage with the panel.

By means of forming the first or second lower lip portion 139, 129 and at least part of the locking strip 13*a*, 11*a* by means of the same tool set Ts1, Ts1' i.e. simultaneously, it is facilitated that the production tolerance of dimension d1, d1' between locking strip 13*a*, 11*a* and first or second lower lip portion 139, 129 may be improved.

By means of forming the first or second lower lip portion 139, 129 and at and an outermost surface 187 of the first or second lower lip portion 139, 129 by means of the same tool set Ts1, Ts1', i.e. simultaneously, it is facilitated that the production tolerance of dimension d2, d2' corresponding to the horizontal extension of the first or second lower lip portion 139, 129 may be constant.

By means of forming the first upper edge surface 182, 182' and the locking element surface 181, 181' by means of the same tool set Ts1, Ts1', it is facilitated that tolerance of the dimension d3, d3' between the first upper edge surface 182, 182' and the locking element surface 181, 181' may be improved.

By means of forming the first upper lip portion 149 and lower surface 14*f*, 12*f* of the first or second locking tongue 14*h*, 12*h* by means of the same tool set Ts4, Ts4', i.e. simultaneously, it is facilitated that the production tolerance of the dimension d4, d4' between the first upper lip portion 149 and lower surface 14*f*, 12*f* of the first or second locking tongue 14*h*, 12*h* may be improved.

The dimension d4, d4' may be formed to provide play between the lower surface 14*f*, 12*f* of the first or second locking tongue 14*h*, 12*h* and the locking strip 13*a*, 11*a* when adjacent panels are configured in assembled position.

The upper surface 186 of the first locking tongue 14*h* may face the first upper lip portion 149 to thereby form a third locking groove for receiving the first lower lip portion 139 of an adjacent panel by means of a folding displacement of an adjacent panel.

By means of forming the upper surface 186 of the first locking tongue 14*h* and the first upper lip portion 149 by means of the same tool set Ts4, it is facilitated that the production tolerance of the distance between the upper surface 186 of the first locking tongue 14*h* and the first upper lip portion 149 may be improved.

Items

ITEM 1. A method for producing mechanical locking systems in a building panel, such as a floor panels or wall panels, the panel comprising a first mechanical locking system at opposite third and fourth edges (13, 14), such as long edges, the mechanical locking system comprising a first pair of horizontal locking surfaces (181, 182) in the third edge (13) and a second pair of horizontal locking surfaces (183, 184) in the fourth edge (14) for horizontal locking of adjacent panels (10, 20), the first pair of horizontal locking surfaces comprising a first upper edge surface (182) of the panel and a locking element surface (181) provided on a locking element (13*b*) protruding from a locking strip (13*a*), the second pair of horizontal locking surfaces comprising a second upper edge surface (184) and a locking groove surface (183) provided by a locking groove (14*g*) configured to receive a locking element (13*b*) of an adjacent panel (20) in response to a folding movement of the adjacent panel (10) for horizontal locking of the panels from parting away from each other, a second locking system at respective parallel and opposite first and second edges (11, 12), such as short edges, configured to cooperate for horizontal and vertical locking of two adjacent building panels (10, 30), preferably by means of a vertical motion, such as vertical folding, a first pair of vertical locking surfaces (139, 185) in the third edge (13) and a second pair of vertical locking surfaces (149, 186) in the fourth edge (14) for vertical locking of adjacent panels, the first pair of vertical locking surfaces (139, 185) comprising a first lower lip portion (139) disposed below said first upper edge surface (182) and a tongue groove surface (185) provided by a tongue groove (13*j*) configured to receive a locking tongue (14*h*) of a fourth edge (14) of an adjacent panel (10) for vertical locking of the adjacent panel in a direction along the normal of a front surface (15) of the panel, the second pair of vertical locking surfaces (149, 186) comprising an upper surface (186) of the locking tongue (14*h*) and a first upper lip portion (149) disposed between a front surface (15) of the panel and the locking tongue (14*h*) and below a second upper edge surface (184);

the first lower lip portion (139) being configured to cooperate with the first upper lip portion (149) provided below the second upper edge surface (184) of an adjacent panel (20) for vertical locking of the panels when said third and fourth edges are assembled in the locking position, the method comprising:

displacing the floor panel in a feeding direction (FD) with its third edge (13) relative to a first tool set (TS1) and relative to a second tool set (TS2);

the first tool set (TS1) comprising a first and second tool member (TM11, TM12) arranged on a common rotary shaft; the second tool set (TS2) comprises a first and second tool member (TM21, TM22) arranged on a common rotary shaft;

forming by the first tool set (TS1), preferably the first tool member (TM11), at least part of the locking element (13*b*) and at least part of the locking strip (13*a*); wherein forming at least part of the locking element (13*b*) comprises forming at least part of the locking element surface (181);

forming with the first tool set (TS1), preferably the second tool member (TM12), at least part of locking strip (13*a*), the first upper edge surface (182) and the first lower lip portion (139);

forming with the second tool set (TS2), preferably the first tool member (TM21), at least a part of the locking element (13*b*);

forming with the second tool set (TS2), preferably the second tool member (TM22), at least part of the tongue groove (13*j*), wherein forming at least part of the tongue groove (13*j*) comprises forming at least part of the tongue groove surface (185);

ITEM 2. The method according to item 1, further comprising:

displacing the floor panel in a feeding direction (FD) with its fourth edge (14) relative to a third tool set (TS3) and a fourth tool set (TS4);

the third tool set (TS3) comprises a first and second tool member (TM31, TM32) arranged on a common rotary shaft; the fourth tool set (TS4) comprises a first and second tool member (TM41, TM42) arranged on a common rotary shaft;

forming with the third tool set (TS3) at least part of the locking groove (14*g*), wherein forming at least part of the locking groove (14*g*) comprises forming at least part of the locking groove surface (183);

forming with the fourth tool set (TS4), preferably the first tool member (TM41), at least part of the locking tongue (14*h*);

forming with the fourth tool set (TS4), preferably the second tool member (TM42), at least part of the locking tongue (14*h*) and at least part of the first upper lip portion (149), wherein forming at least part of the locking tongue (14*h*) comprises forming at least part of the upper tongue surface (186).

ITEM 3. The method according to items 1 or 2, wherein the first tool members and the second tool members (TM11, TM12; TM21, TM22; TM31, TM32; TM41, TM42) of a respective tool set (TS1', TS2', TS3', TS4') each comprises a rotatable disk or rotatable cutting tool configured to be adjustable in relation to each other, preferably in a direction long a centre axis (Ax) of the common rotary shaft.

ITEM 4. The method according to the preceding item, wherein said rotatable discs or rotatable cutting tools of each tool set are configured to be least partially overlapping in a direction along a centre axis (Ax) of the common rotary shaft.

ITEM 5. The method according to any one of the preceding items, wherein the first tool set (TS1) and the third tool set (TS3) are arranged opposing each other on opposite sides of the panel, in a width direction (W) of the panel, and configured to simultaneously engage with the panel.

ITEM 6. The method according to any one of the preceding items, wherein the second tool set (TS2) and the fourth tool set (TS4) are arranged opposing each other on opposite sides of the panel, in a width direction (W) of the panel, and configured to simultaneously engage with the panel.

ITEM 7. The method according to any one of the preceding items, comprising displacing the floor panel in a feeding direction (FD) with its first edge (11) relative to a first tool set (TSV) and relative to a second tool set (TS2');

the first tool set (TS1') comprising a first and second tool member (TM11', TM12') arranged on a common rotary shaft; the second tool set (TS2') comprising a first and second tool member (TM21', TM22') arranged on a common rotary shaft;

forming by the first tool set (TS1'), preferably the first tool member (TM11'), at least part of the locking element (11*b*) and at least part of the locking strip (11*a*); wherein forming at least part of the locking element (11*b*) comprises forming at least part of the locking element surface (181');

forming with the first tool set (TS1'), preferably the second tool member (TM12'), at least part of locking strip (11*a*), the first upper edge surface (182') and the second lower lip portion (119);

forming with the second tool set (TS2'), preferably the first tool member (TM21), at least a part of the locking element (11*b*);

ITEM 8. The method according to item 7, further comprising:

displacing the floor panel in a feeding direction (FD) with its second edge (12) relative to a third tool set (TS3') and a fourth tool set (TS4');

the third tool set (TS3') optionally comprising a first and second tool member (TM31', TM32') arranged on a common rotary shaft; the fourth tool set (TS4') comprises a first, second and third tool member (TM41', TM42', TM43') arranged on a common rotary shaft;

forming with the third tool set (TS3') at least part of the locking groove (12*g*), wherein forming at least part of the locking groove (12*g*) comprises forming at least part of the locking groove surface (183');

forming with the fourth tool set (TS4'), preferably the first tool member (TM41), at least part of the second locking tongue (14*h*), wherein forming of at least part of the locking tongue (12*h*) comprises forming at least part of a lower surface (12*f*) of the locking tongue (12*h*);

forming with the fourth tool set (TS4'), preferably the second tool member (TM42'), at least part of the locking tongue (12*h*) and at least part of the first upper lip portion (149), forming with the fourth tool set (TS4'), preferably the third tool member (TM43'), at least part of a tongue groove (12*j*) configured to receive a displaceable locking tongue of a first edge (11) of an adjacent panel for vertical locking of panels.

ITEM 9. The method according to item 7 or 8, wherein the first, second and third tool members (TM11', TM12'; TM21', TM22'; TM31', TM32'; TM41', TM42', TM43') of a respective tool set (TS1', TS2', TS3', TS4') each comprises a rotatable disk or rotatable cutting tool configured to be adjustable in relation to each other, preferably in a direction long a centre axis (Ax) of the common rotary shaft.

ITEM 10. The method according to the preceding item, wherein said rotatable discs or rotatable cutting tools of each tool set are configured to be least partially overlapping in a direction along a centre axis (Ax) of the common rotary shaft.

ITEM 11. The method according to any one of the preceding items, wherein the first tool set (TS1') and the third tool set (TS3') are arranged opposing each other on opposite sides of the panel, in a longitudinal direction (L) of the panel, and configured to simultaneously engage with the panel.

ITEM 12. The method according to any one of the preceding items, wherein the second tool set (TS2') and the fourth tool set (TS4') are arranged opposing each other on opposite sides of the panel, in a longitudinal direction (L) of the panel, and configured to simultaneously engage with the panel.

The invention claimed is:

1. A method for producing mechanical locking systems in a building panel, the building panel comprising a first mechanical locking system at opposite third and fourth edges, the mechanical locking system comprising a first pair of horizontal locking surfaces in the third edge and a second pair of horizontal locking surfaces in the fourth edge for horizontal locking of adjacent building panels, the first pair of horizontal locking surfaces comprising a first upper edge surface of the building panel and a locking element surface provided on a locking element protruding from a locking strip, the second pair of horizonal locking surfaces comprising a second upper edge surface and the locking groove surface provided by a locking groove configured to receive the locking element of one of the adjacent building panels in response to a folding movement of the adjacent building panel for horizontal locking of the building panels from parting away from each other, a second mechanical locking system at respective parallel and opposite first and second edges, configured to cooperate for horizontal and vertical locking of two of the adjacent building panels, a first pair of vertical locking surfaces in the third edge and a second pair of vertical locking surfaces in the fourth edge for vertical locking of adjacent building panels, the first pair of vertical locking surfaces comprising a first lower lip portion disposed below said first upper edge surface and a tongue groove surface provided by a tongue groove configured to receive a locking tongue of a fourth edge of an adjacent building panel for vertical locking of the adjacent building panel in a direction along the normal of a front surface of the building panel, the second pair of vertical locking surfaces comprising an upper surface of the locking tongue and a first upper lip portion disposed between a front surface of the building panel and the locking tongue and below the second upper edge surface;

the first lower lip portion being configured to cooperate with the first upper lip portion provided below the second upper edge surface of one of the adjacent building panels for vertical locking of the building panels when said third and fourth edges are assembled in locking position, the method comprising:

displacing the building panel in a third edge feeding direction with its third edge relative to a first tool set and relative to a second tool set;

the first tool set comprising a first and second tool member arranged on a first tool set common rotary shaft; the second tool set comprises a first and second tool member arranged on a second tool set common rotary shaft;

forming with the first tool set, at least part of the locking element and at least part of the locking strip, wherein forming at least part of the locking element comprises forming at least part of the locking element surface, and at least part of locking strip, the first upper edge surface, and the first lower lip portion;

forming with the second tool set, at least a part of the locking element of the building panel and at least part of the tongue groove, wherein forming at least part of the tongue groove comprises forming at least part of the tongue groove surface.

2. The method according to claim 1, further comprising:

displacing the building panel in a fourth edge feeding direction with its fourth edge relative to a third tool set and a fourth tool set;

the third tool set comprises a first and second tool member arranged on a third tool set common rotary shaft; the fourth tool set comprises a first and second tool member arranged on a fourth tool set common rotary shaft;

forming with the third tool set at least part of the locking groove, wherein forming at least part of the locking groove comprises forming at least part of the locking groove surface;

forming with the fourth tool set, at least part of the locking tongue;

forming with the fourth tool set, at least part of the locking tongue and at least part of the first upper lip portion, wherein forming at least part of the locking tongue comprises forming at least part of the upper tongue surface.

3. The method according to claim 1, wherein the first tool members and the second tool members of the respective first and second tool sets each comprise a rotatable disk or rotatable cutting tool configured to be adjustable in relation to each other.

4. The method according to claim 3, wherein said rotatable disks or rotatable cutting tools of each of the respective tool sets are configured to be at least partially overlapping in a direction along a center axis of the respective common rotary shaft.

5. The method according to claim 1, wherein the first tool set and the third tool set are arranged opposing each other on opposite sides of the building panel, in a width direction of the building panel, and configured to simultaneously engage with the building panel.

6. The method according to claim 1, wherein the second tool set and the fourth tool set are arranged opposing each other on opposite sides of the building panel, in a width direction (W) of the building panel, and configured to simultaneously engage with the building panel.

7. The method according to claim 2, comprising displacing the building panel in a first edge feeding direction with its first edge relative to a fifth tool set and relative to a sixth tool set;

the fifth tool set comprising a first and second tool member arranged on a fifth tool set common rotary shaft; the sixth tool set comprising a first and second tool member arranged on a sixth tool set common rotary shaft;

forming with the fifth tool set, at least part of a first edge locking element and at least part of a first edge locking strip, wherein forming at least part of the first edge locking element comprises forming at least part of the first edge locking element surface and at least part of a first edge locking strip, a first edge first upper edge surface and a first edge second lower lip portion;

forming with the sixth tool set, at least a part of the first edge locking element.

8. The method according to claim 7, further comprising:

displacing the building panel in a second edge feeding direction with its second edge relative to a seventh tool set and an eighth tool set;

the seventh tool set optionally comprising a first and second tool member arranged on a seventh tool set common rotary shaft; the eighth tool set comprises a first, second and third tool member arranged on an eighth tool set common rotary shaft;

forming with the seventh tool set at least part of a second edge locking groove, wherein forming at least part of the second edge locking groove comprises forming at least part of a second edge locking groove surface;

forming with the eighth tool set, at least part of a second edge locking tongue, wherein forming of at least part of the second edge locking tongue comprises forming at least part of a lower surface of the second edge locking tongue, at least part of the second edge locking tongue, at least part of a second edge first upper lip portion, at least part of a second tongue groove configured to receive a displaceable locking tongue of a first edge of an adjacent building panel for vertical locking of building panels.

9. The method according to claim 8, wherein the first and second tool members of a respective one of the first through the seventh tool sets comprises a rotatable disk or rotatable cutting tool configured to be adjustable in relation to each other.

10. The method according to claim 9, wherein said rotatable disks or rotatable cutting tools of the first and second tool members of the respective one of the first through the seventh tool sets are configured to be least partially overlapping in a direction along a center axis of the respective common rotary shaft.

11. The method according to claim 8, wherein the fifth tool set and the seventh tool set are arranged opposing each other on opposite sides of the building panel, in a longitudinal direction of the building panel, and configured to simultaneously engage with the building panel.

12. The method according to claim 8, wherein the sixth tool set and the eighth tool set are arranged opposing each other on opposite sides of the building panel, in a longitudinal direction of the building panel, and configured to simultaneously engage with the building panel.

13. The method according to claim 8, wherein the first, second and third tool members of the eighth tool set each comprises a rotatable disk or rotatable cutting tool configured to be adjustable in relation to each other.

* * * * *